US009885976B2

(12) United States Patent
Sato

(10) Patent No.: US 9,885,976 B2
(45) Date of Patent: Feb. 6, 2018

(54) SEAL CONFIGURATION FOR A TONER CARTRIDGE OF AN IMAGE FORMING APPARATUS

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/293,493

(22) Filed: Oct. 14, 2016

(65) Prior Publication Data

US 2017/0108800 A1 Apr. 20, 2017

(30) Foreign Application Priority Data

Oct. 15, 2015 (JP) ..... 2015-203510

(51) Int. Cl.
*G03G 15/08* (2006.01)

(52) U.S. Cl.
CPC ..... *G03G 15/0881* (2013.01)

(58) Field of Classification Search
CPC ..... G03G 15/0881
See application file for complete search history.

(56) References Cited

U.S. PATENT DOCUMENTS 8,180,260 B2 5/2012 Yanagi
2009/0142105 A1* 6/2009 Yanagi ..... G03G 15/0891 399/265

FOREIGN PATENT DOCUMENTS

JP 2009-151280 A 7/2009

* cited by examiner

*Primary Examiner* — G. M. Hyder
(74) *Attorney, Agent, or Firm* — Banner & Witcoff, Ltd.

(57) ABSTRACT

An image forming apparatus includes: a frame; a photosensitive drum that is supported by the frame; a developing unit that is rotatable around a rotating shaft supported by the frame and includes a developing frame having a toner receiving port and a developing roller; a toner cartridge that has a toner supply port; and a seal member that positioned a circumference of the toner receiving port and is deformable, wherein the seal member has a communication opening, which communicates between the toner receiving port and the toner supply port in a state where the toner cartridge is mounted to the frame, and the seal member has a first end and a second end, wherein when the developing unit rotates to approach the toner cartridge, the first end of the seal member and the second end of the seal member are configured to be compressed.

13 Claims, 14 Drawing Sheets

SEAL CONFIGURATION FOR A TONER CARTRIDGE OF AN IMAGE FORMING APPARATUS

CROSS-REFERENCE TO RELATED APPLICATION

This application claims priority from Japanese Patent Application No. 2015-203510 filed on Oct. 15, 2015, the entire subject matter of which is incorporated herein by reference.

BACKGROUND

This disclosure relates to an image forming apparatus that employs an electrophotographic method.

There is an image forming apparatus that employs an electrophotographic method and includes a photosensitive drum, a developing unit having a developing roller, and a toner cartridge that accommodates toner.

As such an image forming apparatus, there is an image forming apparatus in which a supply port of a toner cartridge and a receiving port of a developing unit face each other to supply toner contained in the toner cartridge to the developing unit.

In such image forming apparatus, the developing unit is configured to swing with respect to the photosensitive drum.

In such an image forming apparatus, in a state where the amount of toner contained in the toner cartridge is large, it is difficult to swing the toner cartridge together with the developing unit. Thus, there is a configuration in which the developing unit swings with respect to not only the photosensitive drum but also the toner cartridge.

There is an image forming apparatus in which a seal member made of an elastic member is disposed at a circumference of a supply port and an abutting state between a toner cartridge and a developing unit is maintained, thereby preventing toner from being scattered between from a supply port of the toner cartridge and a receiving port of the developing unit.

SUMMARY

When a developing unit swings to approach a toner cartridge, there are a part of which a seal member is compressed as the developing unit approaches the toner cartridge and a part of which the seal member is decompressed as the developing unit departs from the toner cartridge.

Therefore, the seal member reliably abuts on the toner cartridge in the compressed part of the seal member, thereby suppressing toner leakage. However, the seal member is spaced from the toner cartridge to form a gap in the decompressed part of the seal member, thereby causing toner leakage.

This disclosure provides an image forming apparatus that can suppress toner leakage between the toner cartridge and the developing unit.

An image forming apparatus of this disclosure includes: a frame; a photosensitive drum that is supported by the frame; a developing unit that is rotatable around a rotating shaft supported by the frame and includes a developing frame having a toner receiving port and a developing roller; a toner cartridge that has a toner supply port; and a seal member that positioned a circumference of the toner receiving port and is deformable, wherein the seal member has a communication opening, which communicates between the toner receiving port and the toner supply port in a state where the toner cartridge is mounted to the frame, and the seal member has a first end and a second end positioned at a side opposite to the first end with the communication opening interposed therebetween. When the developing unit rotates to approach the toner cartridge, the first end of the seal member and the second end of the seal member are configured to be compressed.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Figure 1:
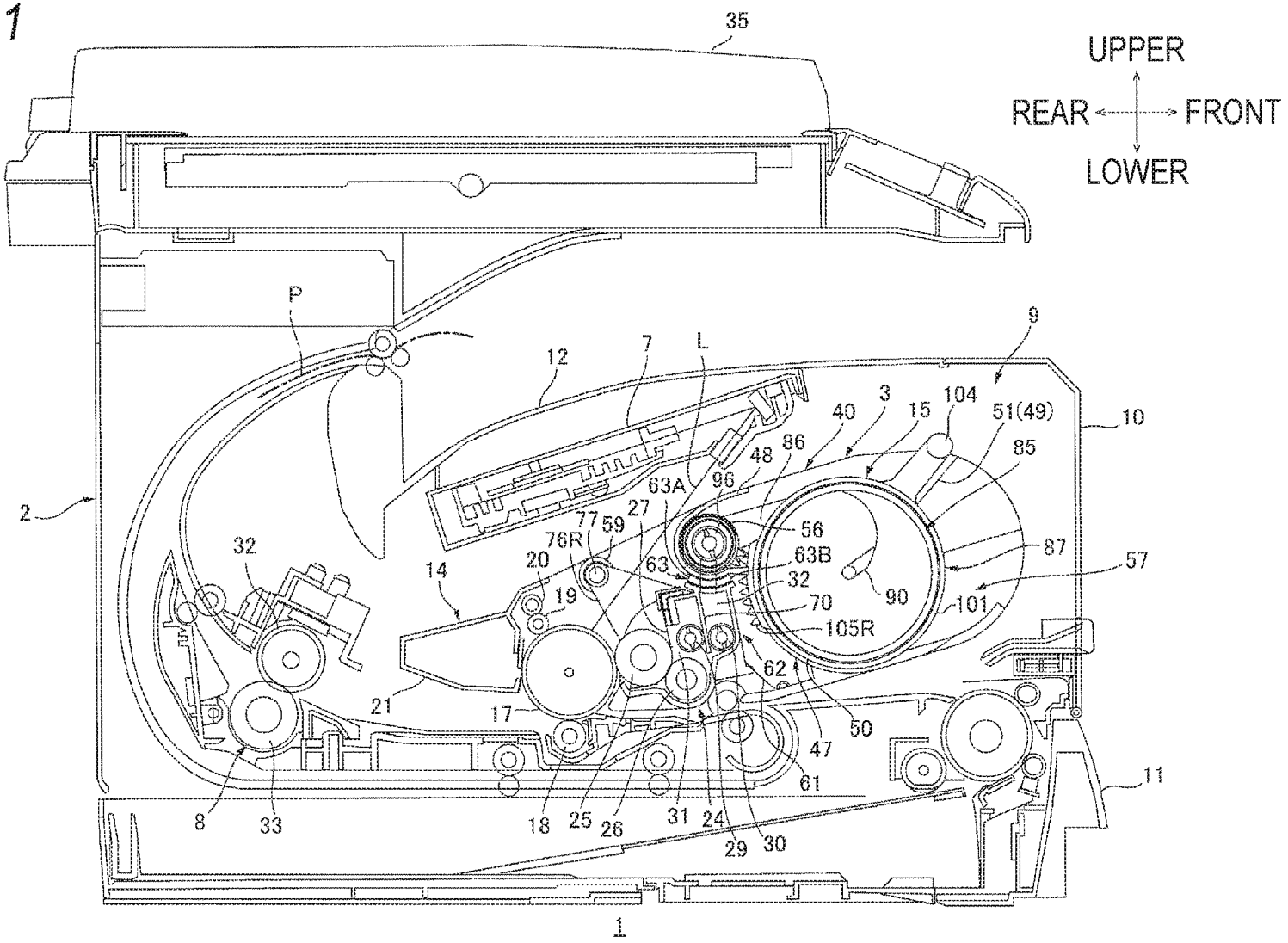
FIG. 1 is a cross-sectional view at a center illustrating an image forming apparatus according to a first embodiment of the invention.

An image forming apparatus 1 will be described below. In the following description, directions will be specified based on directions indicated by arrows as illustrated in the drawings.

1. Outline of Printer

As illustrated in FIG. 1, the image forming apparatus 1 is a monochromatic printer employing an electrophotographic method. The image forming apparatus 1 includes a main body 2 having an opening 9, a process cartridge 3, a scanning unit 7, a fixing unit 8, and a reading unit 35.

The main body 2 has an almost box shape. The main body 2 includes a front cover 10, a sheet supply tray 11, and a sheet discharge tray 12.

The opening 9 is positioned at a front end of the main body 2. The opening 9 is formed to communicate between the inside and outside of the main body 2. The opening 9 allows the process cartridge 3 to pass therethrough.

The front cover 10 is positioned at the front end of the main body 2. The front cover 10 has an almost plate shape extending in an up-down direction. The front cover 10 is supported by the front end of the main body 2 so as to be pivotally swingable around a lower end of the front cover 10. The front cover 10 is swingable between an open position at which the opening 9 is open and a closed position at which the opening 9 is closed (see FIGS. 9 and 10).

The sheet supply tray 11 is positioned at a lower end of the main body 2. The sheet supply tray 11 is configured to accommodate sheets P of paper.

The sheet discharge tray 12 is positioned at a substantially center in a front-rear direction of an upper surface of the main body 2. The sheet discharge tray 12 is recessed downward form the upper surface of the main body 2 so that the sheets P are placed thereon.

The process cartridge 3 is mountable to and demountable from the main body 2. The process cartridge 3 is positioned at a substantially vertical center inside the main body 2. The process cartridge 3 is positioned above the sheet supply tray 11 and below of the sheet discharge tray 12. The process cartridge 3 includes a drum unit 14 and a toner cartridge 15.

The drum unit 14 includes a photosensitive drum 17, a transfer roller 18, a charging roller 19, a charging cleaning roller 20 configured to remove extraneous matters such as a residual toner or sheet dust adhered onto a surface of the charging roller 19, a drum cleaning unit 21 configured to collect the extraneous matters adhered to the photosensitive drum 17 and store them, and a developing unit 24.

The photosensitive drum 17 is positioned at a rear end of the drum unit 14. The photosensitive drum 17 has an almost cylindrical shape extending in a right-left direction.

The transfer roller 18 is positioned below the photosensitive drum 17. The transfer roller 18 is in contact with the photosensitive drum 17.

The charging roller 19 is positioned at a rear upper side of the photosensitive drum 17. The charging roller 19 is in contact with the photosensitive drum 17. The charging roller 19 is configured to charge the surface of the photosensitive drum 17.

The developing unit 24 is positioned in front of the photosensitive drum 17. The developing unit 24 includes a developing roller 25, a supply roller 26, and a layer thickness regulation blade 27.

The developing roller 25 is positioned at a rear end of the developing unit 24. The developing roller 25 is in contact with a front side of a circumferential surface of the photosensitive drum 17. The developing roller 25 is rotatably supported by the developing unit 24. That is, the developing roller 25 and the photosensitive drum 17 are arranged in the front-rear direction.

The supply roller 26 is positioned below a front of the developing roller 25. The supply roller 26 is in contact with a surface at a front lower side of the developing roller 25. The supply roller 26 is rotatably supported by the developing unit 24.

The layer thickness regulation blade 27 is positioned at a front upper side of the developing roller 25. A lower end of the layer thickness regulation blade 27 is in contact with a front surface of the developing roller 25.

The toner cartridge 15 is mountable to and demountable from the drum unit 14. The toner cartridge 15 is positioned in front of the developing unit 24. The toner cartridge 15 can accommodate a toner. Although details will be described below, the toner cartridge 15 can supply the toner accommodated therein to the developing unit 24.

The scanning unit 7 is positioned above the process cartridge 3. The scanning unit 7 can emit a laser beam L based on image data toward the photosensitive drum 17.

The fixing unit 8 is positioned in the rear of the process cartridge 3. The fixing unit 8 includes a heating roller 32 and a pressing roller 33 coming in contact with the heating roller 32.

The reading unit 35 is positioned above the main body 2. The reading unit 35 is positioned above the sheet discharge tray 12 while keeping an interval. The reading unit 35 is a flat bed image scanner. The reading unit 35 is configured to read image information of an original document.

2. Drum Cartridge

Figure 2A:
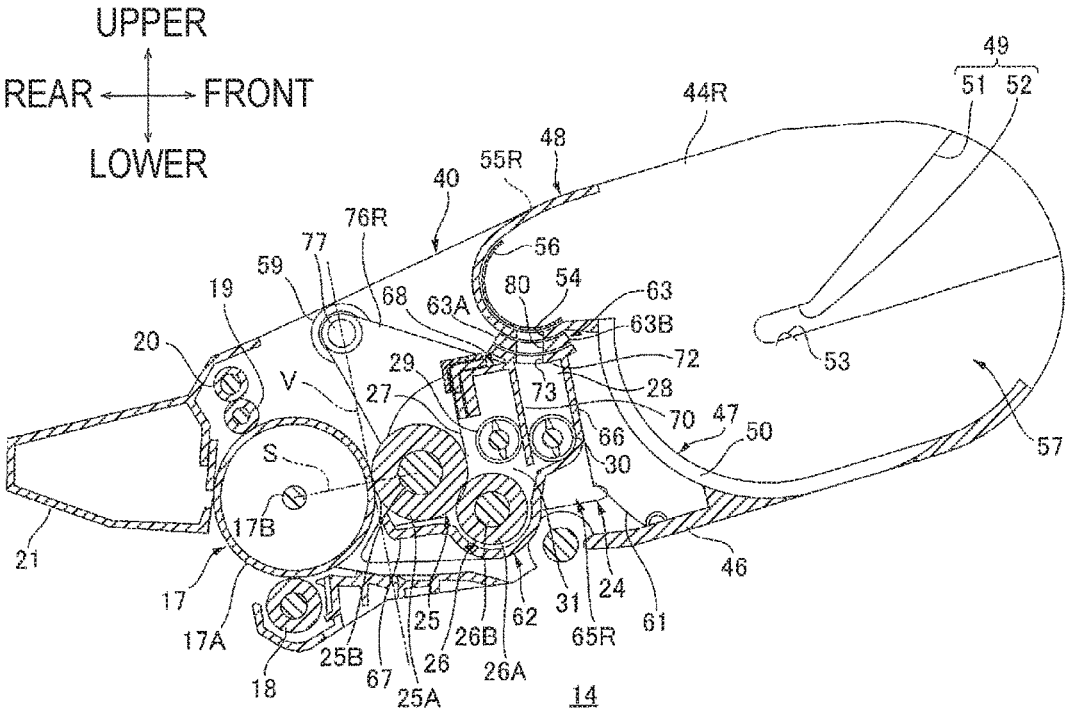
FIG. 2A is a cross-sectional view at a center of a drum cartridge illustrated in FIG. 1.
Figure 3:
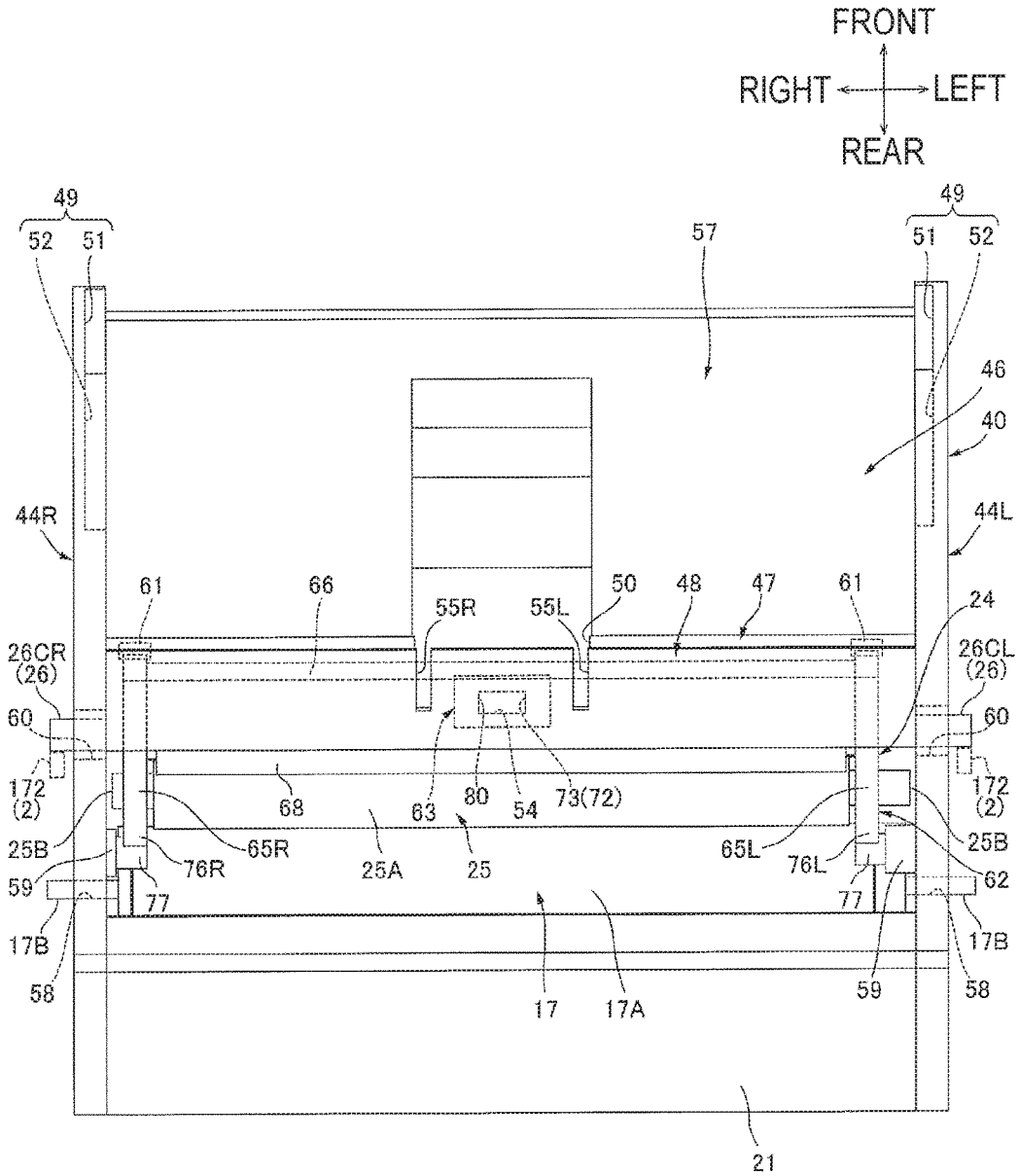
FIG. 3 is a plan view of the drum cartridge illustrated in FIG. 2A.

The drum unit 14 includes a frame 40 that supports the photosensitive drum 17 and the developing unit 24 as illustrated in FIGS. 2A and 3.

(1) Frame

The frame 40 includes a right sidewall 44R, a left sidewall 44L, a lower wall 46, a partition wall 47 having a groove 50, and a partition wall 48 having a toner communication opening 54, a right notch 55R, and a left notch 55L.

The sidewall 44R includes a guide portion 49, a hole 58 into which the photosensitive drum 17 is inserted, a support portion 59, and a hole 60 that receives a protrusion portion 26CR (which will be described below) of the supply roller 26.

Similarly to the sidewall 44R, the sidewall 44L includes the guide portion 49, the hole 58, the support portion 59, a hole 60 that receives a protrusion portion 26CL (which will be described below) of the supply roller 26.

The guide portion 49 will be described with respect to the sidewall 44R, and the hole 58, the support portion 59, and the hole 60 will be described with respect to the sidewall 44L.

The sidewall 44R is positioned at a right end of the frame 40. The sidewall 44R extends in the up-down direction and the front-rear direction. The sidewall 44R has a plate shape.

The guide portion 49 is positioned at a front end of the sidewall 44R. The guide portion 49 is recessed outward in the right-left direction from an inner surface in the right-left direction of the sidewall 44R. The guide portion 49 includes a first groove 51 and a second groove 52.

The first groove 51 extends downward and rearward from a front upper end of the sidewall 44R as illustrated in FIG. 2A. As the first groove 51 extends downward and rearward, the groove becomes smaller in width. The first groove 51 has an almost triangular shape as seen in side view.

The second groove 52 is continuous from a rear lower end of the first groove 51. The second groove 52 extends rearward from the rear lower end of the first groove 51. The second groove 52 includes a locking portion 53.

The locking portion 53 is positioned at a substantially center of the second groove 52 in the front-rear direction. The locking portion 53 protrudes upward from a bottom of the second groove 52. The locking portion 53 is a plate spring.

Figure 2B:
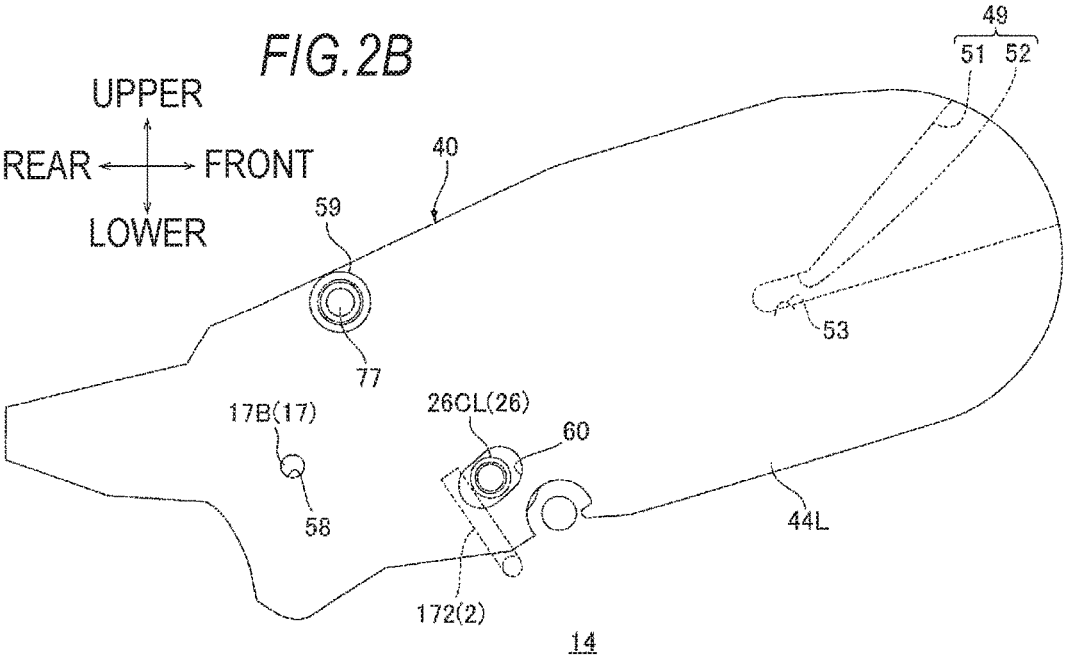
FIG. 2B is a side view of the drum cartridge illustrated in FIG. 2A.

The sidewall 44L is positioned at a left end of the frame 40 as illustrated in FIGS. 2B and 3. The sidewall 44L extends in the up-down direction and the front-rear direction. The sidewall 44L has a plate shape.

The hole 58 is positioned in front of the drum cleaning unit 21 as viewed from the right-left direction. The hole 58 penetrates through the sidewall 44L in the right-left direction. The hole 58 has a circular shape as seen in side view.

The support portion 59 is positioned at a front upper side of the hole 58. The support portion 59 extends in the right-left direction. The support portion 59 has a cylindrical shape. An outer end in the right-left direction of the support portion 59 is substantially flush with an outer end in the right-left direction of the sidewall 44L. An inner end in the right-left direction of the support portion 59 is positioned inward in the right-left direction from an inner surface in the right-left direction of the sidewall 44L.

The hole 60 is positioned in front of the hole 58 and is positioned at a front lower side of the support portion 59. The hole 60 penetrates through the sidewall 44L in the right-left direction. The hole 60 has a long-hole shape. The hole 60 has an almost arc shape around the support portion 59.

As illustrated in FIGS. 2A and 3, the lower wall 46 is positioned at the lower end of the frame 40. The lower wall 46 is positioned between the lower end of the sidewall 44R and the lower end of the sidewall 44L. The lower wall 46 extends in the right-left direction and the front-rear direction. The lower wall 46 has a plate shape. The lower wall 46 is provided with two springs 61.

Two springs 61 are positioned substantially at a substantially center in the longitudinal direction of the lower wall 46. Two springs 61 are positioned in front of the developing unit 24. Two springs 61 are spaced apart from each other with an interval in the right-left direction. Each of the springs 61 is a coil spring. A base end of the spring 61 is fixed to the lower wall 46. A free end of the spring 61 extends upward.

The partition wall 47 is positioned in the rear of the second groove 52 of the sidewall 44R and the sidewall 44L as viewed in the right-left direction. The partition wall 47 is positioned between the developing unit 24 and the second groove 52. The partition wall 47 extends rearward and upward from the substantially center of the lower wall 46 in the front-rear direction. The partition wall 47 is positioned between the sidewall 44R and the sidewall 44L. The partition wall 47 is curved upward as it extends rearward. The partition wall 47 has an almost arc shape around the rear end of the second groove 52.

The groove 50 is positioned at a substantially center of the partition wall 47 in the right-left direction. The groove 50 penetrates through the partition wall 47 in the front-rear direction. The groove 50 extends in the up-down direction. The groove 50 has an almost rectangular shape as seen in front view. The groove 50 is continuous from the partition wall 47 and extends to the front end of the lower wall 46.

The partition wall 48 is positioned at a rear upper side of the partition wall 47. The partition wall 47 extends in the right-left direction. The partition wall 48 has an almost semi-cylindrical shape in which a front thereof is open. The partition wall 48 is positioned between the sidewall 44R and the sidewall 44L. A front lower end of the partition wall 48 is connected to the upper end of the partition wall 47. The partition wall 48 is provided with a lock portion 56.

The lock portion 56 is positioned inside the partition wall 48 in the radial direction. The lock portion 56 extends in the right-left direction. The lock portion 56 has an almost semi-cylindrical shape in which a front thereof is open. An outer circumferential surface of the lock portion 56 is formed along an inner circumferential surface of the partition wall 48. The lock portion 56 is movable along the inner circumferential surface of the partition wall 48 between a first position (see FIG. 2A) and a second position (see FIG. 7A). In the first position, the lock portion 56 is positioned at a rear end inside the partition wall 48 such that a front side is opened and the toner communication opening 54 of the partition wall 48 is closed. In the second position (see FIG. 7A), the lock portion 56 is positioned at an upper end inside the partition wall 48 such that a lower side is opened and is engaged with a conveyance tube 94 (which will be described below) of the toner cartridge 15 and the toner communication opening 54 of the partition wall 48 is opened.

The toner communication opening 54 is positioned at a substantially center of the partition wall 48 in the right-left direction. The toner communication opening 54 penetrates through a circumferential surface below the partition wall 48 in the up-down direction. The toner communication opening 54 has an almost rectangular shape as seen in a plane view.

The notch 55R is positioned at an upper end of the partition wall 48. As illustrated in FIG. 3, the notch 55R overlaps with the right end of the groove 50 as seen in the up-down direction. The notch 55R penetrates through a front upper end of the partition wall 48 in the up-down direction. The notch 55R extends, in a substantially straight line, rearward from the front upper end of the partition wall 48.

The notch 55L is positioned at the upper end of the partition wall 48. The notch 55L overlaps with the left end of the groove 50 as seen in the up-down direction. The notch 55L penetrates through the front upper end of the partition wall 48 in the up-down direction. The notch 55L extends, in a substantially straight line, rearward from the front upper end of the partition wall 48.

Although details will be described below, the toner cartridge 15 is mounted in front of the partition wall 47 in the frame 40. In this way, a portion, which is defined by the partition wall 47, the front of the lower wall 46, and the front of the sidewall 44R and the sidewall 44L, is a toner cartridge mounting portion 57 in the frame 40.

(2) Photosensitive Drum

The photosensitive drum 17 includes a drum body 17A and a drum shaft 17B as illustrated in FIGS. 2A and 3.

The drum body 17A is positioned at an outer circumferential part of the photosensitive drum 17 in a radial direction of the photosensitive drum 17. The drum body 17A extends in the right-left direction. The drum body 17A has a cylindrical shape in which both right and left ends are closed.

The drum shaft 17B is positioned at a center of the photosensitive drum 17 in the radial direction of the photosensitive drum 17. The drum shaft 17B extends in the right-left direction. The drum shaft 17B has a columnar shape. A right end of the drum shaft 17B protrudes rightward beyond a right end of the drum body 17A as illustrated in FIG. 3. The right end of the drum shaft 17B is inserted into the hole 58 of the sidewall 44R. The right end of the drum shaft 17B protrudes rightward beyond the sidewall 44R. A left end of the drum shaft 17B protrudes leftward beyond a left end of the drum body 17A. The left end of the drum shaft 17B is inserted into the hole 58 of the sidewall 44L. The left end of the drum shaft 17B protrudes leftward beyond the sidewall 44L.

(3) Developing Unit

As illustrated in FIGS. 2A and 4, the developing unit 24 is positioned at a substantially center of the drum unit 14 in the front-rear direction. The developing unit 24 includes a developing frame 62 that supports the developing roller 25 and the supply roller 26 described above, a first screw 29, a second screw 30, a communication opening 80, and a seal member 63.

(3-1) Developing Frame

As illustrated in FIGS. 2A and 3, the developing frame 62 includes a right sidewall 65R, a left sidewall 65L, a front wall 66, a lower wall 67, an upper wall 68, a compartment wall 70, a right arm 76R, and a left arm 76L.

The sidewall 65R is positioned at a right end of the developing frame 62. The sidewall 65R extends in the up-down direction and the front-rear direction. The sidewall 65R has a plate shape.

The sidewall 65L is positioned at a left end of the developing frame 62. The sidewall 65L extends in the up-down direction and the front-rear direction. The sidewall 65L has a plate shape.

The front wall 66 is positioned at a front end of the developing frame 62. The front wall 66 is positioned between a front end of the sidewall 65R and a front end of the sidewall 65L. The front wall 66 extends in the up-down direction and the right-left direction. The front wall 66 has a plate shape.

As illustrated in FIG. 2A, the lower wall 67 is positioned at a lower end of the developing frame 62. The lower wall 67 is positioned between a lower end of the sidewall 65R and a lower end of the sidewall 65L. The lower wall 67 extends in the front-rear direction and the right-left direction. The lower wall 67 has a plate shape. A front end of the lower wall 67 is connected to a lower end of the front wall 66.

As illustrated in FIGS. 2A and 3, the upper wall 68 is positioned at an upper end of the developing frame 62. The upper wall 68 is positioned between an upper end of the sidewall 65R and an upper end of the sidewall 65L. The upper wall 68 extends in the front-rear direction and the right-left direction. A front end of the upper wall 68 is connected to an upper end of the front wall 66 as illustrated in FIG. 2A. A rear end of the upper wall 68 supports the layer thickness regulation blade 27. The upper wall 68 includes a curved portion 72 having a toner receiving port 73.

The curved portion 72 forms the front end of the upper wall 68. The curved portion 72 has an arc shape that is slightly recessed downward. The curved portion 72 has a plate shape.

As illustrated in FIGS. 2A and 3, the toner receiving port 73 is positioned at a substantially center of the curved portion 72 in the right-left direction. The toner receiving port 73 is positioned in front of the compartment wall 70. The toner receiving port 73 penetrates through the curved portion 72 in the up-down direction.

As illustrated in FIG. 2A, the compartment wall 70 is positioned in the rear of the front wall 66. The compartment wall 70 is positioned between the sidewall 65R and the sidewall 65L. The compartment wall 70 extends downward from a substantially center of the upper wall 68 in the front-rear direction. The compartment wall 70 has a plate shape. A lower end of the compartment wall 70 is positioned in front of the supply roller 26. The lower end of the compartment wall 70 is positioned above the lower wall 67 while keeping an interval.

The compartment wall 70 partitions the internal space of the developing frame 62 into a developing portion 31 positioned in the rear of the compartment wall 70 and a toner accommodating portion 28 positioned in front of the compartment wall 70.

As illustrated in FIGS. 2A and 3, the arm 76R extends rearward and upward from the upper surface of the sidewall 65R. The arm 76R has an almost triangular shape that becomes narrower toward the rear and upper side. The arm 76R has a plate shape. The arm 76R is provided with a rotating shaft 77.

The rotating shaft 77 is positioned at a rear upper end of the arm 76R. Specifically, as illustrated in FIG. 2A, the rotating shaft 77 is positioned on a virtual line V that is a tangent line of the photosensitive drum 17 and is orthogonal to a segment S passing between an axial line of the photosensitive drum 17 and an axial line of the developing roller 25. In addition, the rotating shaft 77 is positioned between the axial line of the photosensitive drum 17 and the seal member 63 in an extending direction of the segment S. The rotating shaft 77 is positioned upward from the photosensitive drum 17 and the developing roller 25. As illustrated in FIGS. 2A and 3, the rotating shaft 77 has a columnar shape extending in the right-left direction. An outer end in the right-left direction of the rotating shaft 77 is positioned outward in the right-left direction from the outer surface in the right-left direction of the arm 76R. The outer end in the right-left direction of the rotating shaft 77 is inserted into the support portion 59 of the sidewall 44R.

As illustrated in FIG. 3, the arm 76L extends rearward and upward from the upper surface of the sidewall 65L. The arm 76L has the same shape as the arm 76R as projecting in the right-left direction. Similarly to the arm 76R, the arm 76L is provided with a rotating shaft 77. The rotating shaft 77 of the arm 76L is inserted into the support portion 59 of the sidewall 44L.

(3-2) Developing Roller

As illustrated in FIGS. 2A and 3, the developing roller 25 includes a covering portion 25A and a shaft 25B.

The covering portion 25A is positioned at an outer circumferential part of the developing roller 25 in a radial direction of the developing roller 25. The covering portion 25A extends in the right-left direction. The covering portion 25A has a cylindrical shape.

The shaft 25B is positioned at a center of the developing roller 25 in the radial direction of the developing roller 25. The shaft 25B extends in the right-left direction. The shaft 25B has a columnar shape. A right end of the shaft 25B protrudes rightward beyond a right end of the covering portion 25A. The right end of the shaft 25B is rotatably supported by the sidewall 65R. The right end of the shaft 25B protrudes rightward beyond the sidewall 65R. A left end of the shaft 25B protrudes leftward beyond a left end of the covering portion 25A. The left end of the shaft 25B is rotatably supported by the sidewall 65L. The left end of the shaft 25B protrudes leftward beyond the sidewall 65L.

(3-3) Supply Roller

The supply roller 26 includes a covering portion 26A, a shaft 26B, a right protrusion portion 26CR, and a left protrusion portion 26CL.

The covering portion 26A is positioned at an outer circumferential part of the supply roller 26 in a radial direction of the supply roller 26. The covering portion 26A extends in the right-left direction. The covering portion 26A has a cylindrical shape.

The shaft 26B is positioned at a center of the supply roller 26 in the radial direction of the supply roller 26. The shaft 26B extends in the right-left direction. The shaft 26B has a columnar shape. A right end of the shaft 26B protrudes rightward beyond a right end of the covering portion 26A. The right end of the shaft 26B is rotatably supported by the sidewall 65R. The right end of the shaft 26B protrudes rightward beyond the sidewall 65R. A left end of the shaft 26B protrudes leftward beyond a left end of the covering portion 26A. The left end of the shaft 26B is rotatably supported by the sidewall 65L. The left end of the shaft 26B protrudes leftward beyond the sidewall 65L.

As illustrated in FIG. 3, the protrusion portion 26CR is positioned at a right end of the supply roller 26. The protrusion portion 26CR extends in the right-left direction. The protrusion portion 26CR has a cylindrical shape. The protrusion portion 26CR is fitted into the right end of the shaft 26B. Then, the protrusion portion 26CR is fitted into the hole 60 of the sidewall 44R. The protrusion portion 26CR protrudes outward in the right-left direction beyond the sidewall 44R.

As illustrated in FIGS. 2B and 3, the protrusion portion 26CL is positioned at a left end of the supply roller 26. The protrusion portion 26CL extends in the right-left direction. The protrusion portion 26CL has a cylindrical shape. The protrusion portion 26CL is fitted into the left end of the shaft 26B. Then, the protrusion portion 26CL is fitted into the hole 60 of the sidewall 44L. The protrusion portion 26CL protrudes outward in the right-left direction beyond the sidewall 44L.

(3-4) First Screw and Second Screw

As illustrated in FIG. 2A, the first screw 29 is positioned inside the developing portion 31. Specifically, the first screw 29 is positioned above the supply roller 26 and in the rear of the compartment wall 70. A right end of the first screw 29 is rotatably supported by the sidewall 65R. A left end of the first screw 29 is rotatably supported by the sidewall 65L.

The second screw 30 is positioned inside the toner accommodating portion 28. That is, the second screw 30 is positioned in front of the compartment wall 70. A right end of the second screw 30 is rotatably supported by the sidewall 65R. A left end of the second screw 30 is rotatably supported by the sidewall 65L.

(3-5) Seal Member

The seal member 63 is positioned at an upper surface of the curved portion 72. The seal member 63 is urethane foam. In addition, polyethylene foam or a rubber sponge can be substituted for the seal member 63. The seal member 63 is deformable. The seal member 63 has an almost rectangular shape as seen in plane view. The seal member 63 is bonded to the upper surface of the curved portion 72. The seal member 63 has a shape that is curved along the upper surface of the curved portion 72. The seal member 63 covers the circumference of the toner receiving port 73 of the developing unit 24 and the circumference of the toner supply port 97 of the toner cartridge 15 to be described below.

The communication opening 80 is positioned at a substantially center of the seal member 63 as seen in plane view. The communication opening 80 penetrates through the seal member 63 in the up-down direction. The communication opening 80 has an almost rectangular shape as seen in plane view. The communication opening 80 coincides with the toner receiving port 73 of the curved portion 72 as projecting in the up-down direction.

A front end 63B (second end) of the seal member 63 is positioned at a side opposite to a rear end 63A (first end) of the seal member 63 with the communication opening 80 interposed therebetween.

(4) Assembly State of Developing Unit with respect to Drum Cartridge

As described above, the developing unit 24 is supported by the frame 40 of the drum cartridge 14 as illustrated in FIGS. 2B and 3 in such a manner that the rotating shaft 77 of the arm 76R is inserted into the support portion 59 of the sidewall 65R, the rotating shaft 77 of the arm 76L is inserted into the support portion 59 of the sidewall 65L, the protrusion portion 26CR is fitted into the hole 60 of the sidewall 44R, and the protrusion portion 26CL is fitted into the hole 60 of the sidewall 44L. Thus, the developing unit 24 is pivotally rotatable around the rotating shaft 77 along the hole 60.

As illustrated in FIGS. 2A and 3, the front lower end of the sidewall 65R of the developing unit 24 comes in contact with a rear surface of a free end of the right spring 61. The front lower end of the sidewall 65L of the developing unit 24 comes in contact with a free end of the left spring 61. Thereby, the developing unit 24 is always pressed rearward along the hole 60 by two springs 61. In other words, the spring 61 presses the developing roller 25 toward the photosensitive drum 17.

Thus, the covering portion 25A of the developing roller 25 comes in contact with the photosensitive drum 17.

As illustrated in FIG. 2A, the upper surface of the seal member 63 comes in contact with a lower circumferential surface of the partition wall 48. The seal member 63 is held between the partition wall 48 and the curved portion 72 in a state of being compressed in the up-down direction. That is, the seal member 63 is deformable along a rotation direction of the developing unit 24.

3. Toner Cartridge (1) Structure of Toner Cartridge

Figure 4A:
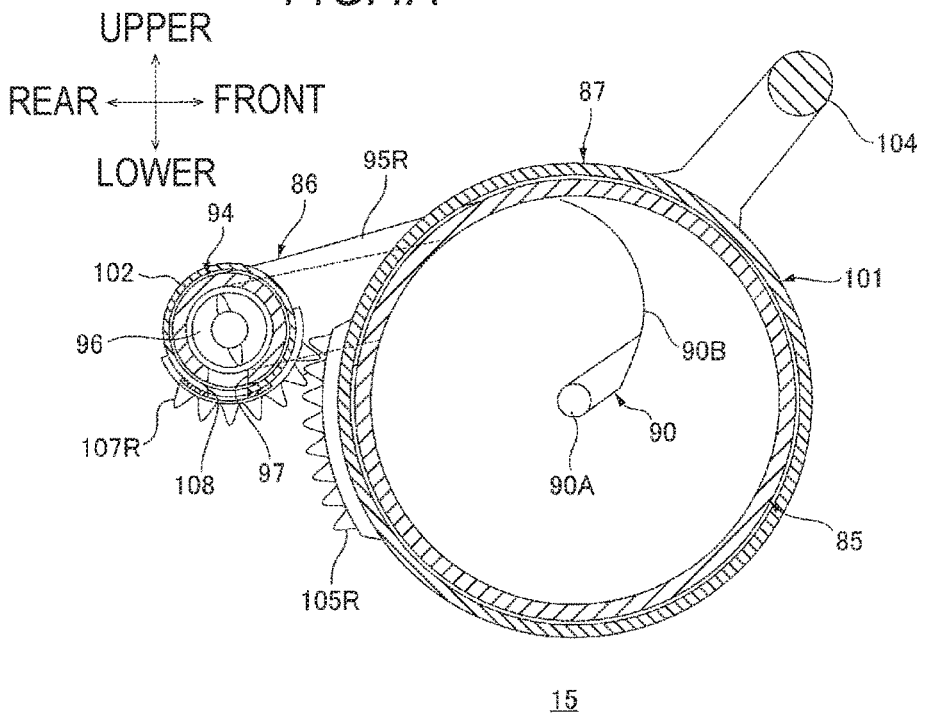
FIG. 4A is a cross-sectional view at a center of a toner cartridge illustrated in FIG. 1 and illustrates a state where a cylinder portion is positioned at an upright position and a shutter is positioned at an open position.
Figure 5:
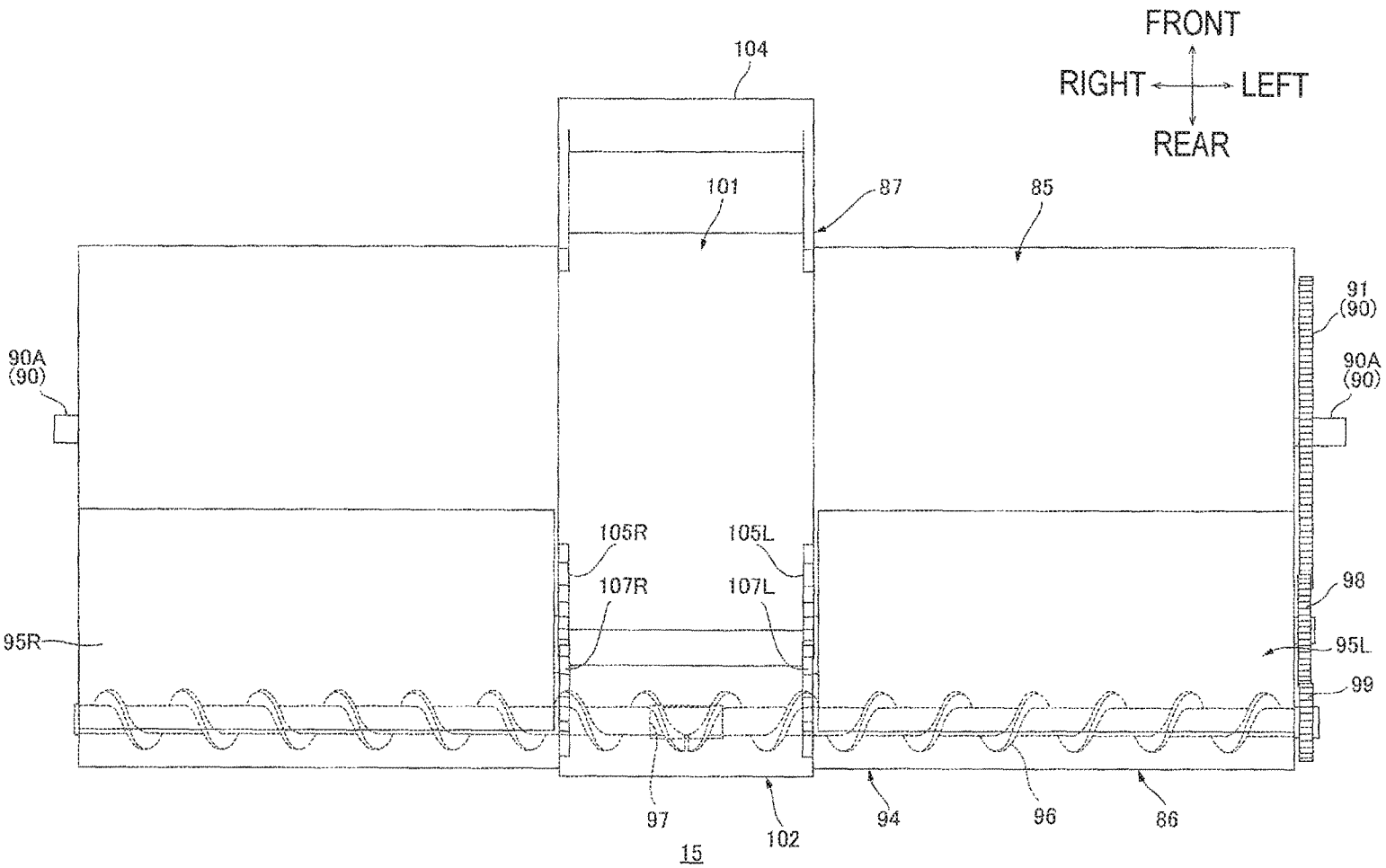
FIG. 5 is a plan view of the toner cartridge illustrated in FIG. 4B.

As illustrated in FIGS. 4A and 5, the toner cartridge 15 includes a toner accommodating portion 85, a conveyance portion 86, and an interlocking portion 87.

(1-1) Toner Accommodating Portion

Figure 6:
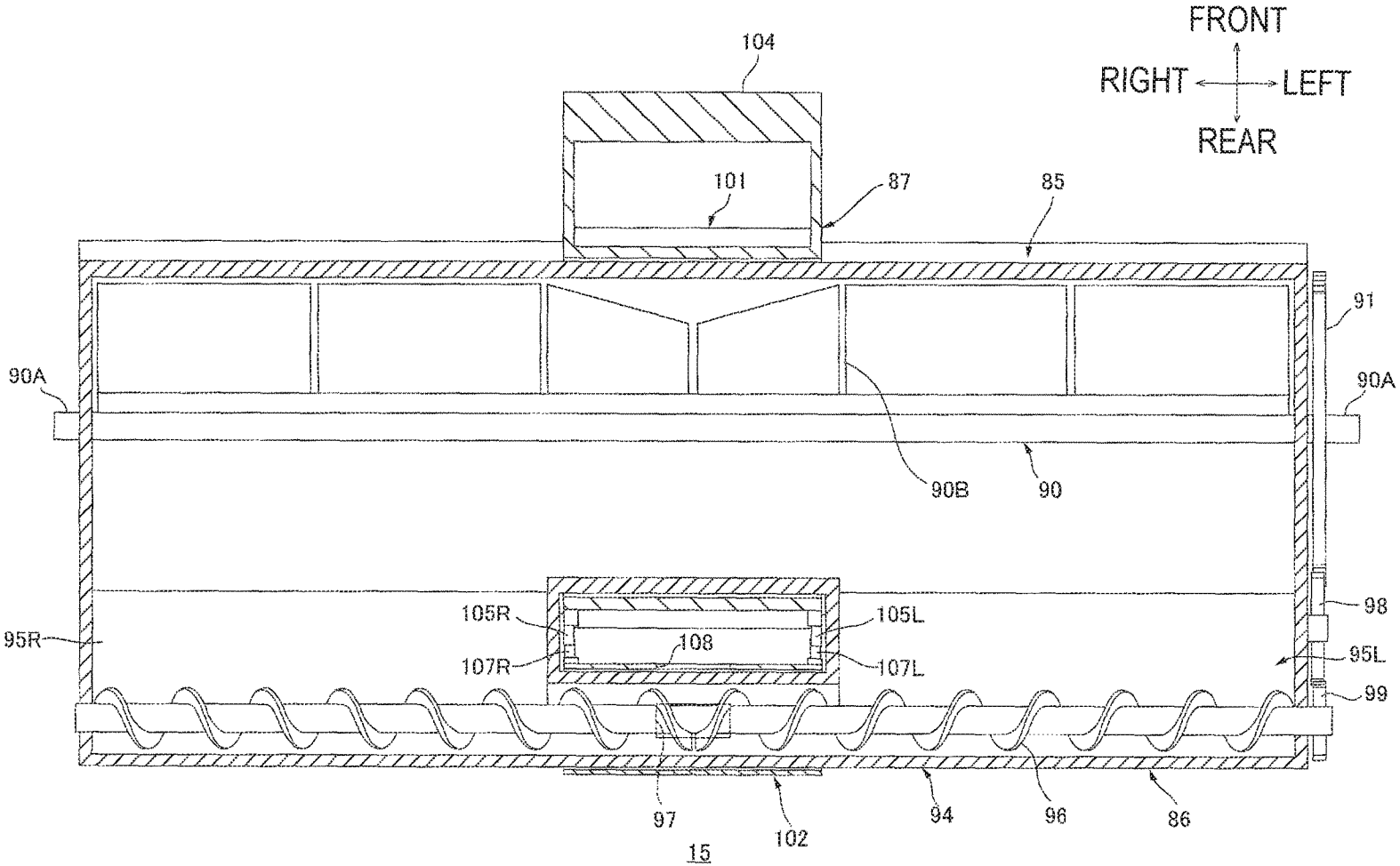
FIG. 6 is a cross-sectional view taken along line A-A of the toner cartridge illustrated in FIG. 4B.

The toner accommodating portion 85 accommodates a toner therein. The toner accommodating portion 85 extends in the right-left direction as illustrated in FIGS. 4A and 6. The toner accommodating portion 85 has an almost cylindrical shape in which both right and left ends are closed. The toner accommodating portion 85 includes an agitator 90.

The agitator 90 includes an agitator shaft 90A, a blade 90B, and an agitator gear 91.

The agitator shaft 90A is positioned at a center of the toner accommodating portion 85 as seen in the right-left direction. The agitator shaft 90A extends in the right-left direction. The agitator shaft 90A has a columnar shape. A right end of the agitator shaft 90A is rotatably supported by a right wall of the toner accommodating portion 85. The right end of the agitator shaft 90A protrudes rightward beyond the right end of the toner accommodating portion 85. A left end of the agitator shaft 90A is rotatably supported by a left wall of the toner accommodating portion 85. The left end of the agitator shaft 90A protrudes leftward beyond the left end of the toner accommodating portion 85.

The blade 90B is positioned within the toner accommodating portion 85. The blade 90B extends outward in a radial direction of the agitator 90 from the agitator shaft 90A. The blade 90B comes in contact with an inner surface of the toner accommodating portion 85.

The agitator gear 91 is positioned to left of the toner accommodating portion 85. The agitator gear 91 is fixed to the left end of the agitator shaft 90A. The agitator gear 91 has gear teeth around the entire circumference. The agitator gear 91 is rotatable with the agitator shaft 90A.

(1-2) Conveyance Portion

The conveyance portion 86 is positioned at a rear upper side of the toner accommodating portion 85. The conveyance portion 86 includes a conveyance tube 94 having the toner supply port 97, a right coupling tube 95R, a left coupling tube 95L, and an auger screw 96.

The conveyance tube 94 is positioned at a rear upper side of the toner accommodating portion 85 while keeping an interval. The conveyance tube 94 extends in the right-left direction. The conveyance tube 94 has an almost cylindrical shape in which both right and left ends are closed. The dimension of the conveyance tube 94 in the right-left direction is approximately equal to the dimension of the toner accommodating portion 85 in the right-left direction.

The toner supply port 97 is positioned at a substantially center of the conveyance tube 94 in the right-left direction. The toner supply port 97 penetrates through a lower circumferential surface of the conveyance tube 94 in the up-down direction. The toner supply port 97 has an almost rectangular shape as seen in plane view.

As illustrated in FIGS. 5 and 6, the coupling tube 95R is positioned between a right rear end of the toner accommodating portion 85 and a right front end of the conveyance tube 94. The coupling tube 95R extends in the front-rear direction. The coupling tube 95R has a rectangular cylindrical shape. The toner accommodating portion 85 and the conveyance tube 94 are communicated with each other through the coupling tube 95R.

The coupling tube 95L is positioned between a left rear end of the toner accommodating portion 85 and a left front end of the conveyance tube 94. The coupling tube 95L extends in the front-rear direction. The coupling tube 95L has a rectangular cylindrical shape. The coupling tube 95L communicates between the toner accommodating portion 85 and the conveyance tube 94. The coupling tube 95L includes an idle gear 98.

The idle gear 98 is positioned to the left of the coupling tube 95L. The idle gear 98 is positioned at the rear of the agitator gear 91. The idle gear 98 is rotatably supported by a left wall of the coupling tube 95L. The idle gear 98 has gear teeth around the entire circumference thereof. The idle gear 98 is engaged with the agitator gear 91.

The auger screw 96 is positioned within the conveyance tube 94. The auger screw 96 extends in the right-left direction. A right half of the auger screw 96 is a left-handed auger screw. A right end of the auger screw 96 is rotatably supported by a right wall of the conveyance tube 94. A left half of the auger screw 96 is a right-handed auger screw. A left end of the auger screw 96 is rotatably supported by a left wall of the conveyance tube 94. The auger screw 96 includes a conveyance gear 99.

The conveyance gear 99 is positioned to the left of the s conveyance tube 94. The conveyance gear 99 is positioned at the rear of the idle gear 98. The conveyance gear 99 is fixed to the left end of the auger screw 98. The conveyance tube 99 has gear teeth around the entire circumference thereof. The conveyance gear 99 is rotatable with the auger screw 96. The conveyance gear 99 is engaged with the agitator gear 98.

(1-3) Interlocking Portion

Figure 4B:
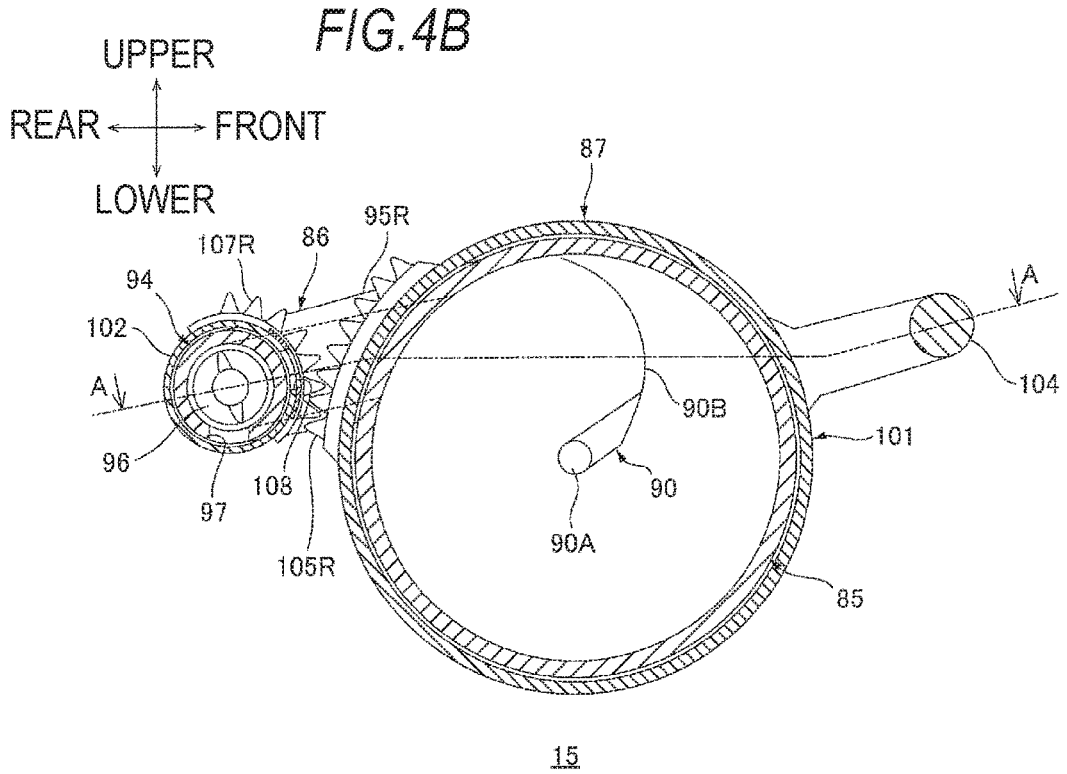
FIG. 4B is a cross-sectional view at a center of the toner cartridge illustrated in FIG. 1 and illustrates a state where the cylinder portion is positioned at a tilt position and the shutter is positioned at a closed position.

As illustrated in FIGS. 4B and 5, the interlocking portion 87 includes a cylinder portion 101 and a shutter 102 having a through-hole 108.

The description will be made with respect to the interlocking portion 87 based on a state where the cylinder portion 101 is positioned at a tilt position and the shutter 102 is positioned at a closed position.

The cylinder portion 101 is positioned at a substantially center of the toner accommodating portion 85 in the right-left direction. The cylinder portion 101 covers a circumferential surface of the toner accommodating portion 85. The cylinder portion 101 extends in the right-left direction. The cylinder portion 101 has a cylindrical shape. The cylinder portion 101 is relatively rotatable with respect to the toner accommodating portion 85. A rear end of the cylinder portion 101 is positioned between the coupling tube 95R and the coupling tube 95L. The cylinder portion 101 includes a handle 104 and gears 105R and 105L.

The handle 104 is positioned at a front end of the cylinder portion 101. The handle 104 extends frontward from the front end of the cylinder portion 101.

The gear 105R is positioned at a right rear end of the cylinder portion 101. The gear 105R is positioned to the left of the coupling tube 95R. The gear 105R is positioned at a rear of the cylinder portion 101 in the range of approximately 45 degrees, as seen in side view. The gear 105R has an almost arc shape. The gear 105R has a plate shape. The gear 105R has gear teeth at a circumferential surface thereof.

The gear 105L is positioned at a left rear end of the cylinder portion 101. The gear 105L is positioned to the right of the coupling tube 95L. The gear 105L has the same shape as the gear 105R as projecting in the right-left direction.

Then, the cylinder portion 101 is movable along the circumferential surface of the toner accommodating portion 85 between a tilt position (see FIG. 4B) at which the handle 104 extends frontward and an upright position (see FIG. 4A) at which the handle 104 is upright to extend frontward and upward.

The shutter 102 is positioned at a center of the conveyance tube 94 in the right-left direction. The shutter 102 covers the circumferential surface of the conveyance tube 94. The shutter 102 is positioned at a rear of the cylinder portion 101. The shutter 102 extends in the right-left direction. The shutter 102 has a cylindrical shape. The shutter 102 is relatively rotatable with respect to the conveyance tube 94. A front end of the shutter 102 is positioned between the coupling tube 95R and the coupling tube 95L. The shutter 102 includes gears 107R and 107L.

The gear 107R is positioned at a right front end of the shutter 102. The gear 107R is positioned to the left of the coupling tube 95R. The gear 107R is positioned at a front of the shutter 102 in the range of approximately 180 degrees, as seen in side view. The gear 107R has an almost arc shape. The gear 107R has a plate shape. The gear 107R has gear teeth at a circumferential surface thereof. The gear 107R is engaged with the gear 105R of the cylinder portion 101.

The gear 107L is positioned at a left front end of the shutter 102. The gear 107L is positioned to the right of the coupling tube 95L. The gear 107L has the same shape as the gear 107R as projecting in the right-left direction. The gear 107L is engaged with the gear 105L of the cylinder portion 101.

As illustrated in FIGS. 4B and 6, the through-hole 108 is positioned at a front of the shutter 102. The through-hole 108 is positioned between the gear 107R and the gear 107L. The through-hole 108 penetrates through a front circumferential surface of the shutter 102 in the front-rear direction. The through-hole 108 has an almost rectangular shape as seen in plane view.

Then, the shutter 102 is movable between a closed position (see FIG. 4B) at which the toner supply port 97 is closed and an open position (see FIG. 4A) at which the through-hole 108 coincides with the toner supply port 97 in the up-down direction and the toner supply port 97 is opened, along the circumferential surface of the conveyance tube 94.

As illustrated in FIG. 4B, the shutter 102 is positioned in the closed position when the cylinder portion 101 is positioned in the tilt position, and is positioned in the open position when the cylinder portion 101 is positioned in the upright position.

(2) Mounting State of Toner Cartridge

Figure 7A:
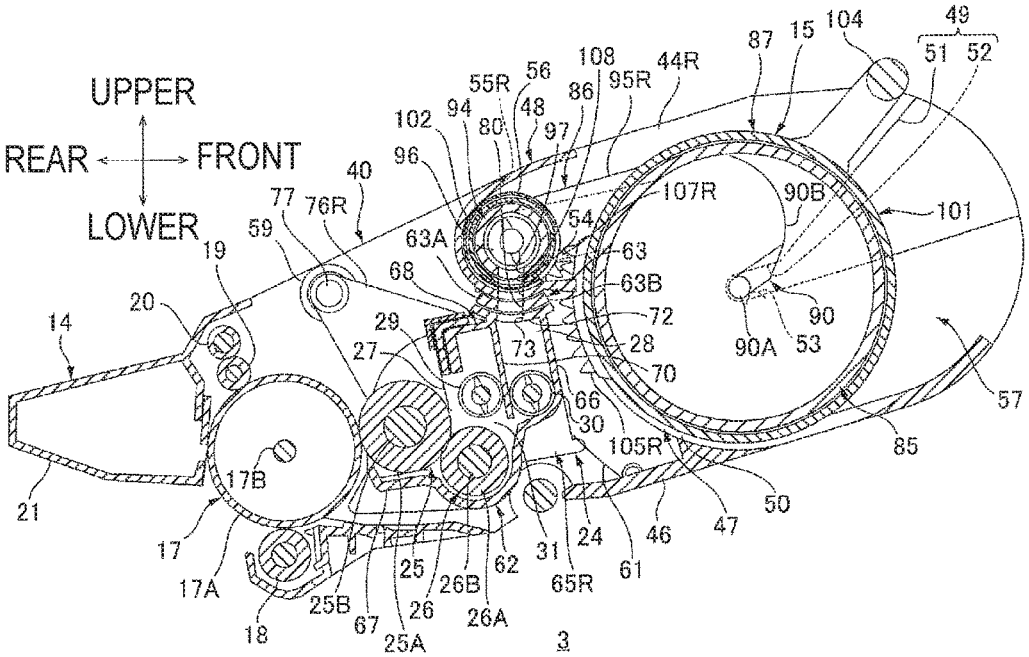
FIG. 7A illustrates a process cartridge illustrated in FIG. 1 and a state where a developing roller comes in contact with a photosensitive drum.

As illustrated in FIG. 7A, the toner cartridge 15 is positioned in front of the partition wall 47 in a state of being mounted to the toner cartridge mounting portion 57. In other words, the toner cartridge 15 is positioned at a side opposite to the photosensitive drum 17 with respect to the developing unit 24 in the arrangement direction of the photosensitive drum 17 and the developing roller 25. The cylinder portion 101 of the interlocking portion 87 is fitted into the groove 50 of the partition wall 47.

At this time, the right end of the agitator shaft 90A is fitted into the rear end of the second groove 52 of the sidewall 44R of the drum unit 14. The right end of the agitator shaft 90A is positioned in the rear of the locking portion 53. The left end of the agitator shaft 90A is fitted into the rear end (not illustrated) of the second groove 52 of the sidewall 44L of the drum unit 14. The left end of the agitator shaft 90A is positioned in the rear of the locking portion 53. Thus, the locking portion 53 regulates movement of toner cartridge 15 toward the front with respect to the guide portion 49.

In addition, the conveyance portion 86 protrudes rearward from the partition wall 47 at an upper side of the partition wall 47. Thus, the conveyance tube 94 of the conveyance portion 86 is received in the partition wall 48 of the frame 40. That is, the partition wall 48 is positioned between the toner cartridge 15 and the seal member 63.

The cylinder portion 101 is positioned at the upright position, and the shutter 102 is positioned at the open position.

At this time, when the shutter 102 is positioned at the open position, the gears 107R and 107L are positioned at a lower side of the shutter 102.

Then, the gears 107R and 107L of the shutter 102 abuts on the lock portion 56 of the partition wall 48, and the lock portion 56 is positioned at a second position.

In this way, the toner supply port 97, the through-hole 108 of the shutter 102, the toner communication opening 54 of the partition wall 48, the communication opening 80 of the seal member 63, and the toner receiving port 73 of the developing unit 24 coincide with each other in the up-down direction. That is, the toner supply port 97 faces the toner receiving port 73 from the above in the state where the toner cartridge 15 is mounted to the toner cartridge mounting portion 57. The seal member 63 is positioned between the toner supply port 97 and the toner receiving port 73. The toner communication opening 54 of the partition wall 48 allows the toner supply port 97 and the toner receiving port 73 to communicate with each other.

The demounting of the toner cartridge 15 from the toner cartridge mounting portion 57 is regulated by the lock portion 56 and the locking portion 53.

4. Details of Main Body

Figure 10:
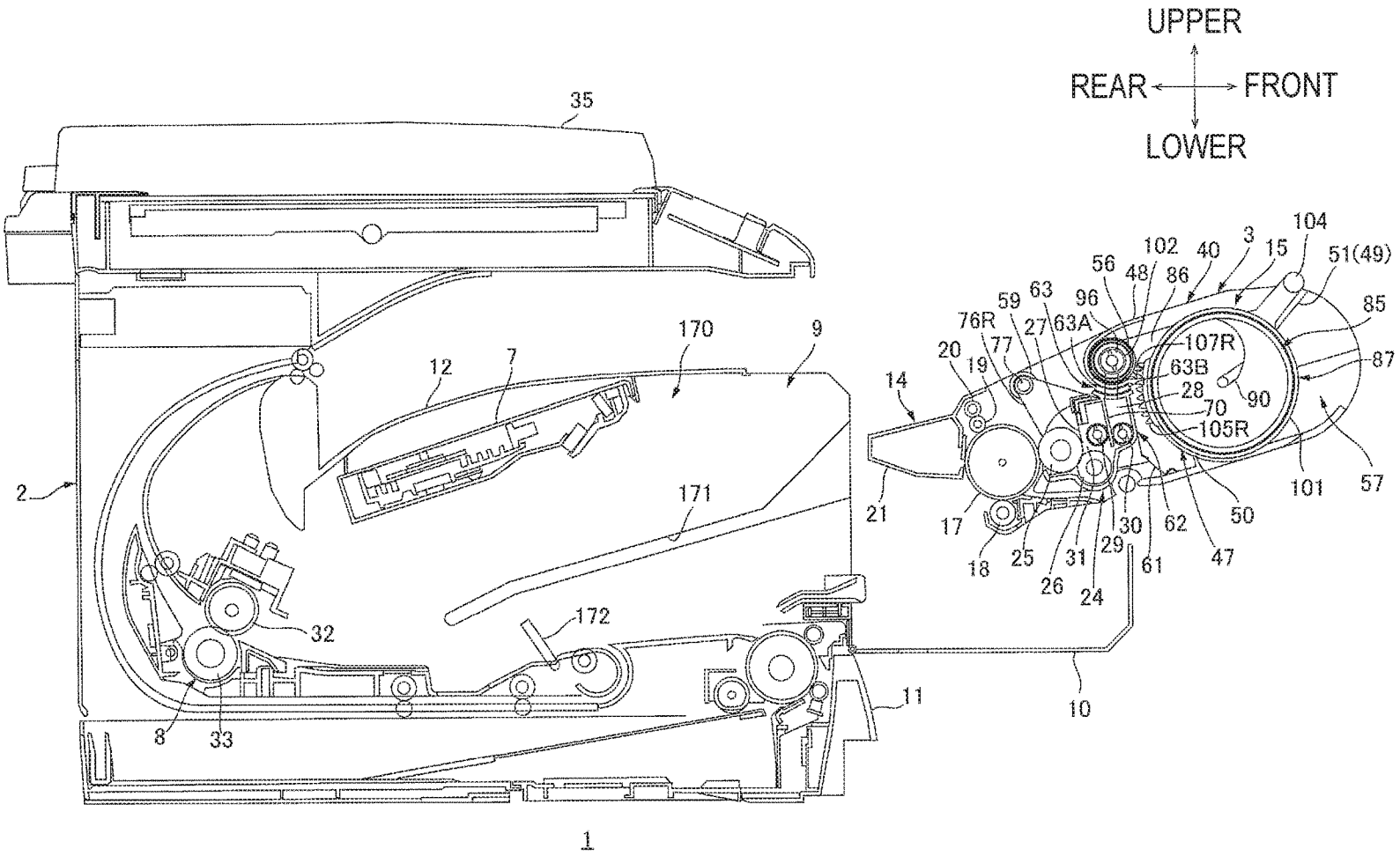
FIG. 10 is an explanatory diagram for explaining a mounting-and-demounting operation of the process cartridge with respect to the image forming apparatus.

As illustrated in FIG. 10, the main body 2 includes a right sidewall 170 having a receiving groove 171, a left sidewall (not illustrated) having the receiving groove 171, and two separation members 172.

The sidewall 170 is positioned at the right end of the main body 2. The sidewall 170 extends in the up-down direction and the front-rear direction. The sidewall 170 has a plate shape.

The receiving groove 171 is recessed outward in the right-left direction from an inner surface in the right-left direction of the sidewall 170. The receiving groove 171 extends rearward and downward from the opening 9.

The sidewall (not shown) is positioned at the left end of the main body 2. The sidewall (not shown) has the receiving groove 171 in the inner surface in the right-left direction thereof, similarly to the sidewall 170.

The receiving groove 171 of the sidewall 170 and the sidewall (not shown) receives the drum shaft 17B of the photosensitive drum 17 of the process cartridge 3.

As a result, the main body 2 supports the process cartridge 3.

Two separation members 172 are positioned in front of the rear lower end of the receiving groove 171 as viewed in the right-left direction. Two separation members 172 are spaced apart from each other in the right-left direction with an interval, as illustrated in FIG. 3. The separation member 172 extends in the up-down direction as illustrated in FIGS. 2B and 10. The separation member 172 has an almost rectangular column shape. The separation member 172 is pivotally rotatable around a lower end of the separation member 172. An upper end of the right separation member 172 faces a front end of the protrusion portion 26CL of the supply roller 26, as illustrated in FIG. 3. As illustrated in FIGS. 2B and 3, an upper end of the left separation member 172 faces a front end of the protrusion portion 26CR. The separation member 172 is configured to separate the developing roller 25 coming in contact with the photosensitive drum 17 from the photosensitive drum 17 by pressing the protrusion portion 26CR and the protrusion portion 26CL.

5. Mounting-and-Demounting Operations of Toner Cartridge and Process Cartridge The toner cartridge 15 is mountable to and demountable from the drum unit 14 even in either a state where the drum unit 14 is mounted to the main body 2 or a state where the drum unit 14 is demounted from the main body 2.

In the following description, mounting-and-demounting operations of the toner cartridge 15 in a state where the drum unit 14 is mounted will be described.

(1) Demounting Operation of Toner Cartridge

Figure 9:
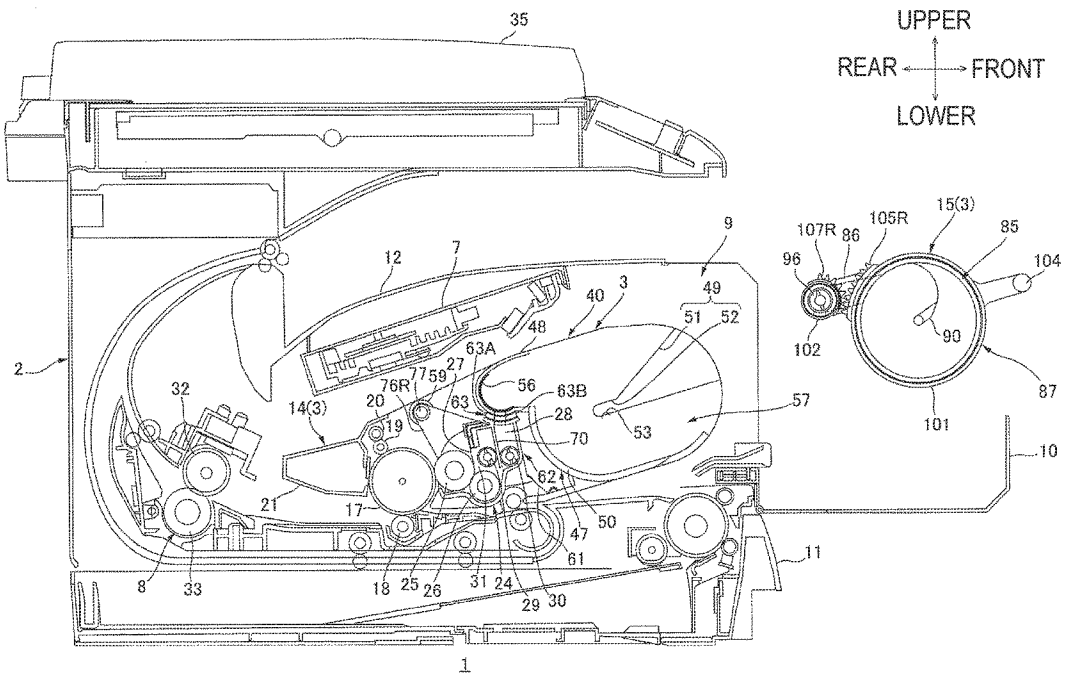
FIG. 9 is an explanatory diagram for explaining a mounting-and-demounting operation of the toner cartridge with respect to the drum cartridge.

When demounting the toner cartridge 15 from the drum unit 14, a worker moves the front cover 10 of the main body 2 to be positioned at the open position as illustrated in FIG. 9.

Subsequently, as illustrated FIG. 8, the worker grips the handle 104 and moves the cylinder portion 101 to be positioned at the tilt position.

Then, the gears 107R and 107L of the shutter 102 abut on the lock portion 56 of the partition wall 48, and the shutter 102 and the lock portion 56 rotate together in a counter-clockwise direction as seen in left side view.

Thus, the shutter 102 is positioned at the closed position, and the lock portion 56 is positioned at the first position.

Then, the worker pulls frontward and upward the toner cartridge 15 from the drum unit 14 as illustrated in FIG. 9.

As a result, the toner cartridge 15 is demounted from the drum unit 14.

(2) Mounting Operation of Toner Cartridge

In order to mount the toner cartridge 15 to the drum unit 14, the front cover 10 is moved to be positioned at the open position.

Figure 8:
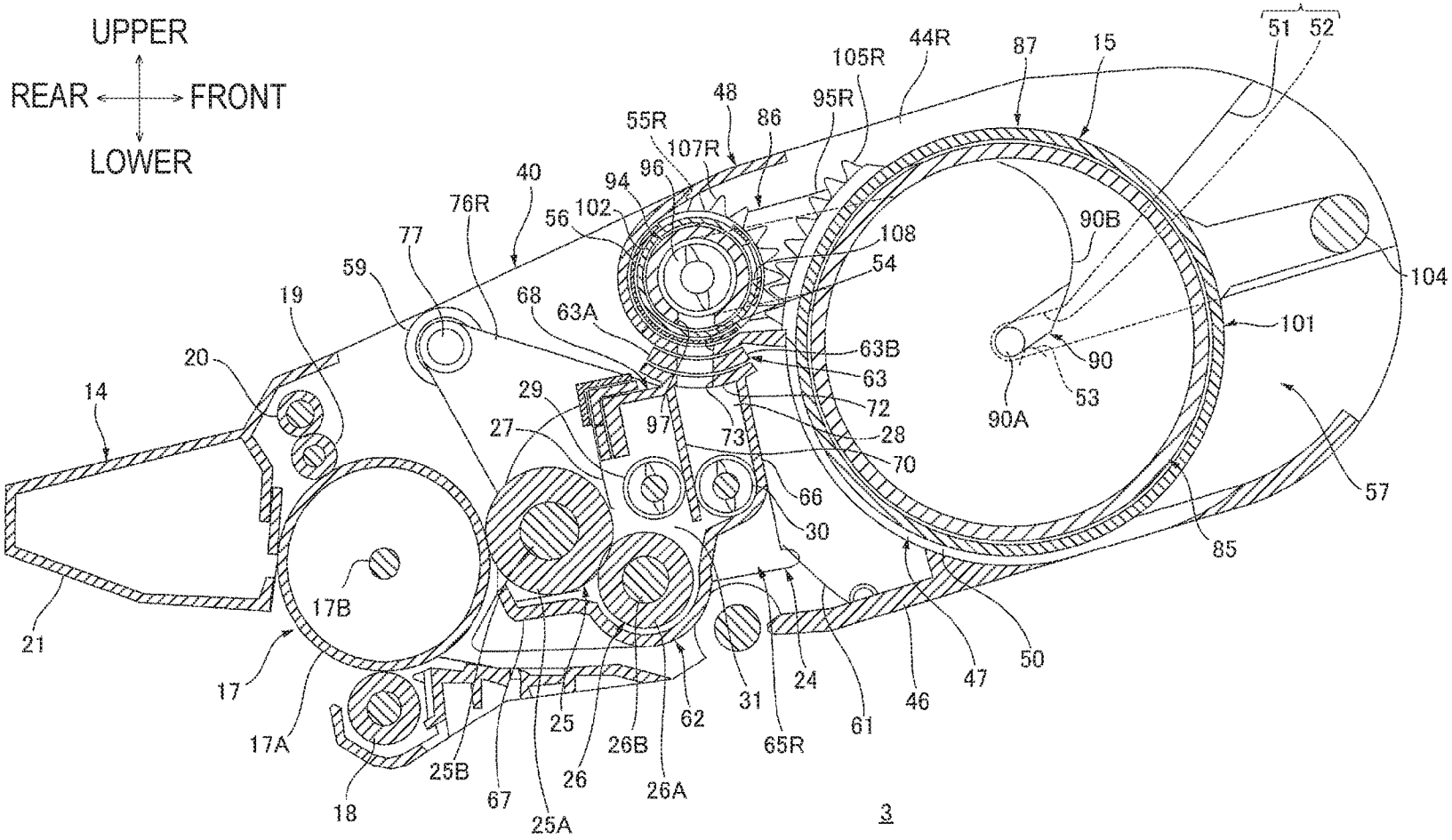
FIG. 8 illustrates a state where the cylinder portion is positioned at a tilt position and the shutter is positioned at a closed position in the process cartridge illustrated in FIG. 7A.

Then, the worker allows the agitator shaft 90A to move along the first groove 51 and the second groove 52 of the guide portion 49, thereby mounting the toner cartridge 15 to the toner cartridge mounting portion 57, as illustrated in FIG. 8.

At this time, the agitator shaft 90A rides over the locking portion 53 and is positioned in the rear of the locking portion 53.

In addition, the conveyance portion 86 is disposed inside the partition wall 48.

Then, the worker grips the handle 104 and moves the cylinder portion 101 from the tilt position to the upright position as illustrated in FIG. 7A.

Then, the gears 107R and 107L of the shutter 102 abut on the lock portion 56 of the partition wall 48, and the shutter 102 and the lock portion 56 rotate together in a clockwise direction as seen in left side view.

Thus, the shutter 102 is positioned at the closed position, and the lock portion 56 is positioned at the first position.

Then, the worker allows the front cover 10 to be positioned at the closed position as illustrated in FIG. 1.

In this way, the toner cartridge 15 is mounted to the drum unit 14.

6. Mounting-and-demounting Operations of Process Cartridge (1) Demounting Operation of Process Cartridge Upon demounting the process cartridge 3 from the main body 2, the worker allows the front cover 10 of the main body 2 to be positioned at the open position as illustrated in FIG. 10.

Then, the worker pulls out frontward and upward the process cartridge 3 from the main body 2.

In this way, the process cartridge 3 moves along the receiving groove 171, and the process cartridge 3 is demounted from the main body 2.

(2) Mounting Operation of Process Cartridge

Upon mounting the process cartridge 3 to the main body 2, the worker inserts the process cartridge 3 into the main body 2 after the front cover 10 is positioned at the open position.

At this time, the drum shaft 17B of the photosensitive drum 17 of the process cartridge 3 moves along the receiving groove 171, and the process cartridge is mounted.

Then, the front cover 10 is moved to be positioned at the closed position.

In this way, the process cartridge 3 is mounted to the main body 2.

7. Image Forming Operation

As illustrated in FIG. 1, when the image forming apparatus 1 starts an image forming operation, the charging roller 19 uniformly charges the surface of the photosensitive drum 17. The scanning unit 7 irradiates with a laser beam L and exposes the surface of the photosensitive drum 17. Thus, an electrostatic latent image based on image data is formed and carried on the surface of the photosensitive drum 17.

In the toner cartridge 15, as illustrated in FIGS. 6 and 7A, the agitator 90 agitates toner contained in the toner accommodating portion 85, and the toner is conveyed to the conveyance tube 94 through the coupling tube 95R and the coupling tube 95L.

Subsequently, the auger screw 96 rotates together due to a driving force input to the conveyance gear 99, and conveys the toner contained in the conveyance tube 94 toward the center of the conveyance tube 94 in the right-left direction.

Then, as illustrated in FIG. 7A, the toner is supplied to the toner accommodating portion 28 through the toner supply port 97, the through-hole 108 of the shutter 102, the toner communication opening 54 of the partition wall 48, the communication opening 80 of the seal member 63, and the toner receiving port 73.

Next, the second screw 30 conveys the toner contained in the toner accommodating portion 28 in the right-left direction. The toner contained in the toner accommodating portion 28 passes through the openings provided at both ends of the compartment wall 70 in the right-left direction, thereby being supplied to the developing portion 31.

The first screw 29 conveys the toner contained in the developing portion 31 in the right-left direction. The toner contained in the developing portion 31 is supplied to the supply roller 26.

Then, the supply roller 26 supplies the toner contained in the developing portion 31 to the developing roller 25. At this time, the toner is positively charged by friction between the developing roller 25 and the supply roller 26, and is carried on the developing roller 25. The layer thickness regulation blade 27 regulates a layer thickness of the toner carried on the developing roller 25 with a certain thickness.

Then, the toner carried on the developing roller 25 is supplied to the electrostatic latent image on the surface of the photosensitive drum 17. Thus, a toner image is carried on the surface of the photosensitive drum 17.

As illustrated in FIG. 1, the sheets P are supplied one by one between the photosensitive drum 17 and the transfer roller 18 from the sheet supply tray 11 at a predetermined timing. The toner image on the surface of the photosensitive drum 17 is transferred to the sheet P while the sheet P passes between the photosensitive drum 17 and the transfer roller 18.

Subsequently, the sheet P is applied with heat and pressure while passing between the heating roller 32 and the pressing roller 33. Thereby, the toner image on the sheet P is thermally fixed to the sheet P.

The sheet P is then loaded in the sheet discharge tray 12.

In the image forming operation described above, the developing unit 24 moves with respect to the photosensitive drum 17 due to the rotation of the photosensitive drum 17 and the developing roller 25. Specifically, the developing unit 24 pivotally rotates around the rotating shaft 77 along the hole 60.

In this way, when the developing unit 24 rotates in the counterclockwise direction as seen in left side view, that is, rotates to approach the toner cartridge 15, the seal member 63 is compressed between the curved portion 72 and the partition wall 48.

Specifically, a part of the curved portion 72 in the rear of the toner receiving port 73 approaches the rear outer circumferential surface of the partition wall 48 in the rear of the toner communication opening 54, and thus the rear end 63A of the seal member 63 is compressed. In addition, a part of the curved portion 72 in front of the toner receiving port 73 approaches the front outer circumferential surface of the partition wall 48 in front of the toner communication opening 54, and thus the front end 63B of the seal member 63 is compressed.

8. Contact/Separation Operation Between Photosensitive Drum and Developing Roller As illustrated in FIG. 2B, the separation member 172 rotates in the clockwise direction around the lower end as seen in left side view, during a cleaning operation or a warm-up operation, for example.

Figure 7B:
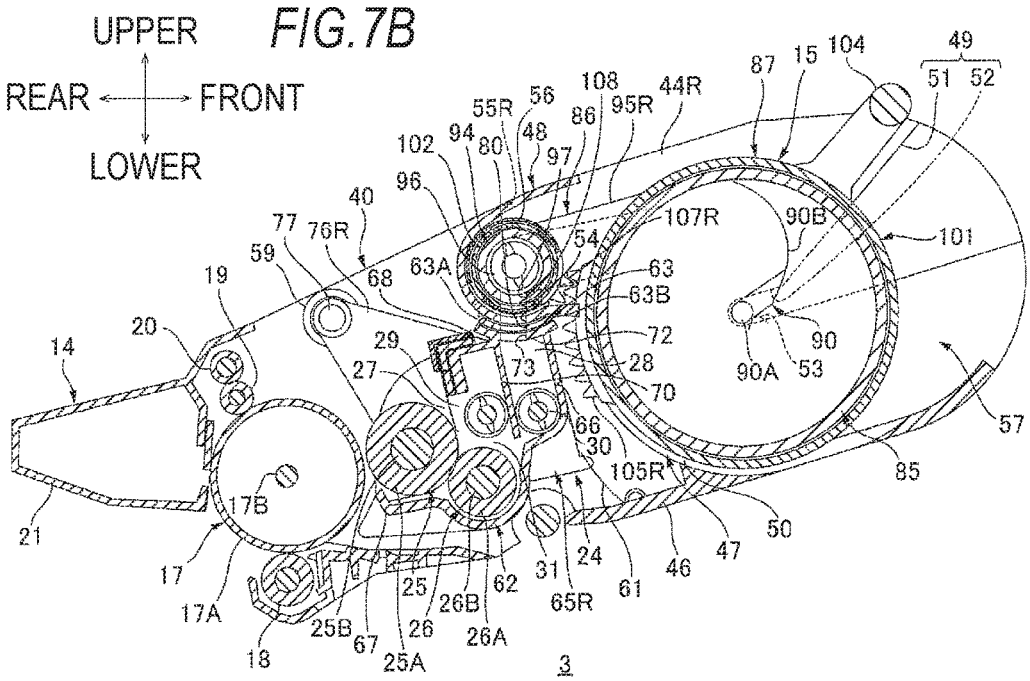
FIG. 7B illustrates the process cartridge illustrated in FIG. 1 and a state where the developing roller is spaced from the photosensitive drum.

Consequently, the separation member 172 presses frontward the protrusion portion 26CR and the protrusion portion 26CL of the supply roller 26. Then, as illustrated in FIG. 7B, the developing unit 24 pivotally rotates around the rotating shaft 77 in the counterclockwise direction along the hole 60, against the biasing force of the spring 61. Thus, the developing unit 24 moves between a contact position, at which the developing roller 25 comes in contact with the photosensitive drum 17, and a separation position, at which the developing roller 25 is separated from the photosensitive drum 17.

Specifically, a part of the curved portion 72 in the rear of the toner receiving port 73 approaches the rear outer circumferential surface of the partition wall 48 in the rear of the toner communication opening 54, and thus the rear end 63A of the seal member 63 is compressed. In addition, a part of the curved portion 72 in front of the toner receiving port 73 approaches the front outer circumferential surface of the partition wall 48 in front of the toner communication opening 54, and thus the front end 63B of the seal member 63 is compressed.

9. Operational Advantages (1) According to the image forming apparatus 1, as illustrated in FIG. 7A, the seal member 63 is disposed to cover the circumference of the toner receiving port 73 of the developing unit 24 and the circumference of the toner supply port 97 of the toner cartridge 15, resulting in suppressing toner leakage.

Then, when the developing unit 24 rotates to approach the toner cartridge 15 as illustrated in FIG. 7B, the rear end 63A and the front end 63B of the seal member 63 are compressed.

Thus, when the developing unit 24 rotates to approach the toner cartridge 15, the seal member 63 can be reliably compressed between the circumference of the toner receiving port 73 and the circumference of the toner supply port 97.

As a result, it is possible to suppress occurrence in a gap between the seal member 63 and the circumference of the toner supply port 97 and occurrence in a gap between the seal member 63 and the circumference of the toner receiving port 73, and thus it is possible to suppress toner leakage between the toner cartridge 15 and the developing unit 24.

(2) According to the image forming apparatus 1, as illustrated in FIG. 2A, the rotating shaft 77 is positioned on a virtual line V that is a tangent line of the photosensitive drum 17 and is orthogonal to a segment S passing between an axial line of the photosensitive drum 17 and an axial line of the developing roller 25.

Therefore, as illustrated in FIG. 7B, when the developing unit 24 rotates, the developing roller 25 can be separated from the photosensitive drum 17 along a tangent line of a circle that is centered around the rotating shaft 77.

Accordingly, it is possible to suppress the generation of frictional force between the photosensitive drum 17 and the developing roller 25 at the time of contact/separation of the developing roller 25 with and from the photosensitive drum 17.

As a result, it is possible to stably rotate the developing unit 24.

(3) According to the image forming apparatus 1, as illustrated in FIG. 2A, since the rotating shaft 77 is positioned between the seal member 63 and the axial line of the photosensitive drum 17 in the extending direction of the segment S, the developing unit 24 can pivotally be rotated with a certainty between the photosensitive drum 17 and the toner cartridge 15 around the rotating shaft 77, as illustrated in FIG. 7B.

(4) According to the image forming apparatus 1, as illustrated in FIGS. 2B and 3, the hole 60 of the frame 40 receives the protrusion portion 26CR and the protrusion portion 26CL of the supply roller 26 which protrude in the axial direction of the developing unit 24, and thus the developing unit 24 can be stably supported by the frame 40.

(5) According to the image forming apparatus 1, as illustrated in FIGS. 2B and 7B, the developing roller 25 is separated from the photosensitive drum 17 by the separation member 172, and thus developing unit 24 rotates to approach the toner cartridge 15.

Thus, since the seal member 63 is compressed between the toner receiving port 73 and the toner supply port 97, it is possible to suppress toner leakage between the toner cartridge 15 and the developing unit 24.

(6) According to the image forming apparatus 1, as illustrated in FIGS. 3 and 7A, the body is pressed by the spring 61, and thus the developing roller 25 can stably come in contact with the photosensitive drum 17.

(7) According to the image forming apparatus 1, as illustrated in FIGS. 7A and 7B, the seal member 63 can be easily deformed according to the rotation of the developing unit 24.

(8) According to the image forming apparatus 1, as illustrated in FIG. 7B, when the developing unit 24 rotates to approach the toner cartridge 15, the seal member 63 can be compressed between the developing unit 24 and the partition wall 48.

Therefore, when the seal member 63 is compressed by the rotation of the developing unit 24, it is possible to suppress a force from being applied to the toner cartridge 15.

That is, when the developing unit 24 rotates, the movement of the toner cartridge 15 can be suppressed by the partition wall 48.

In addition, the toner can be reliably supplied to the toner receiving port 73 from the toner supply port 97 through the toner communication opening 54 of the partition wall 48 communication opening 54.

(9) According to the image forming apparatus 1, as illustrated in FIG. 7B, the developing unit 24 rotates to approach the toner cartridge 15, and thus the toner receiving port 73 can approach the toner supply port 97 such that the toner receiving port 73 is directed upward.

Therefore, the toner can be reliably supplied to the toner receiving port 73 from the toner supply port 97.

(10) According to the image forming apparatus 1, since the conveyance portion 86 is disposed above the seal member 63, the toner contained in the conveyance portion 86 can be supplied to the developing frame 62 by its own weight. Accordingly, the toner can be easily supplied to the developing frame 62 from the conveyance portion 86.

Furthermore, since a part of the toner accommodating portion 85 is disposed below the seal member 63, it is difficult to compress the seal member 63 due to own weight of the toner accommodating portion 85 when the toner cartridge 15 is mounted to the frame 40. Therefore, the developing unit 24 can stably rotate.

10. Second Embodiment

Figure 11A:
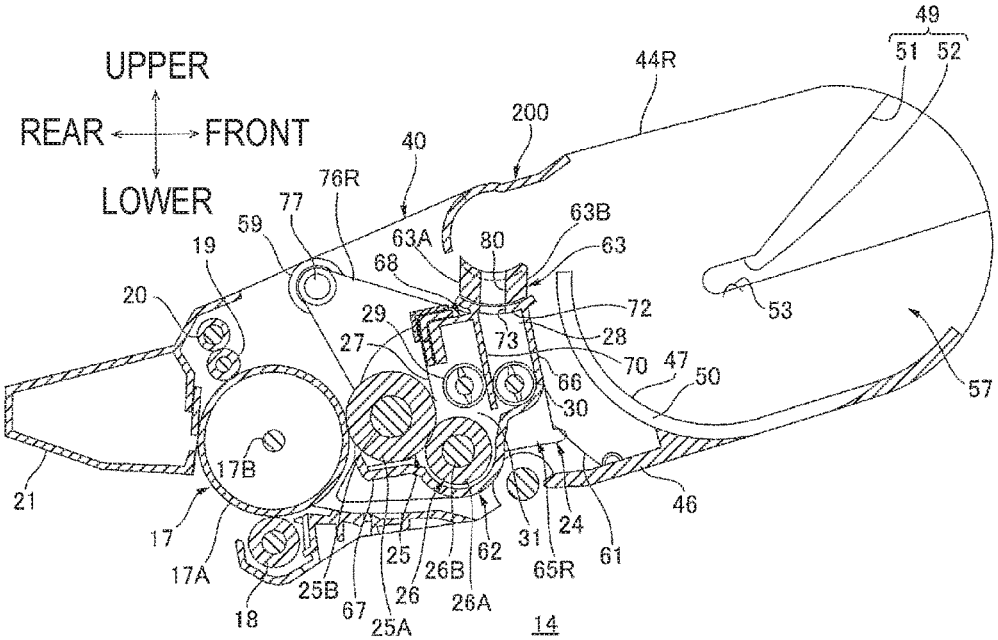
FIG. 11A is a cross-sectional view at a center of a drum cartridge in an image forming apparatus according to a second embodiment of the invention.
Figure 11B:
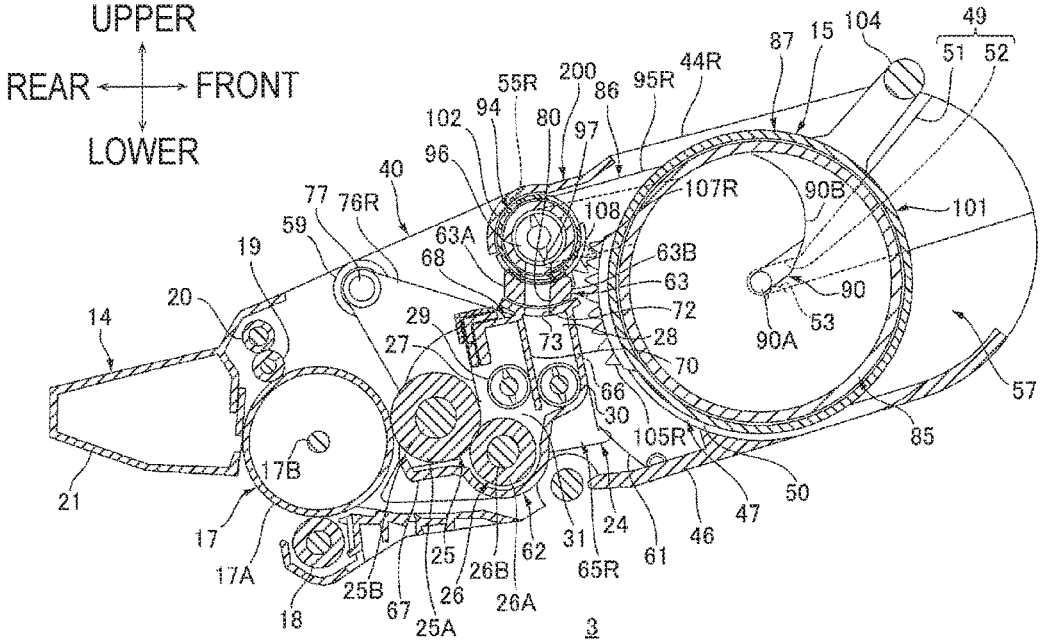
FIG. 11B is a cross-sectional view at a center of a process cartridge in the image forming apparatus according to the second embodiment of the invention.

With reference to FIGS. 11A and 11B, an image forming apparatus according to a second embodiment of the invention will be described. In the second embodiment, the same members as in the first embodiment will be designated by the same reference numerals, and the description thereof will be not presented.

In the first embodiment, as illustrated in FIGS. 2A and 7A, the frame 40 includes the partition wall 48 that receives the conveyance tube 94 of the conveyance portion 86 of the toner cartridge 15.

In contrast, as illustrated in FIG. 11A, a frame 40 may include a contact wall 200 instead of the partition wall 48 in the second embodiment.

The contact wall 200 is positioned at a rear upper side of a partition wall 47 while keeping an interval. The contact wall 200 extends in the right-left direction.

The contact wall 200 has a plate shape. The contact wall 200 is positioned between a sidewall 44R and a sidewall 44L. A rear end of the contact wall 200 is curved toward a rear end 63A of a seal member 63. The rear end of the contact wall 200 is curved along an outer circumferential surface of the conveyance tube 94 of the conveyance portion 86.

In addition, an upper end of a front end 63B of the seal member 63 is inclined downward toward the front.

Then, as illustrated in FIG. 11B, when the toner cartridge 15 is mounted to a toner cartridge mounting portion 57, the conveyance tube 94 of the conveyance portion 86 is received between the rear end of the contact wall 200 and the seal member 63 along the inclination of the upper end of the seal member 63. That is, a lower surface of the seal member 63 comes in contact with a curved portion 72 of the developing unit 24, and an upper surface of the seal member 63 comes in contact with the conveyance tube 94 of the toner cartridge 15.

In this way, the seal member 63 is held in a state of being compressed between the conveyance tube 94 of the toner cartridge 15 and the curved portion 72 of the developing unit 24 in the up-down direction.

The seal member 63 is held in the state of being compressed, and thus The conveyance tube 94 is pressed toward the contact wall 200. Thus, the conveyance tube 94 comes in contact with the contact wall 200.

As described above, when the toner cartridge 15 is mounted to the toner cartridge mounting portion 57, the seal member 63 is compressed.

The toner cartridge 15 is mounted to the toner cartridge mounting portion 57, and thus the seal member 63 is compressed in a direction orthogonal substantially to the mounting direction of the toner cartridge 15.

In other words, the contact wall 200 is positioned at a side opposite to the seal member 63 with respect to the toner cartridge 15 in a rotation direction of the developing unit 24.

Then, when the developing unit 24 rotates in a counterclockwise direction as seen in left side view, that is, rotates to approach the toner cartridge 15, the seal member 63 is compressed between the curved portion 72 and the conveyance tube 94.

Specifically, a part of the curved portion 72 in the rear of the toner receiving port 73 approaches the rear outer circumferential surface of the conveyance tube 94 in the rear of the toner supply port 97, and thus the rear end 63A of the seal member 63 is compressed. In addition, a part of the curved portion 72 in front of the toner receiving port 73 approaches the front outer circumferential surface of the conveyance tube 94 in front of the toner communication opening 54, and thus the front end 63B of the seal member 63 is compressed.

According to the second embodiment, as illustrated in FIG. 11B, the developing unit 24 rotates to approach the toner cartridge 15, and thus the seal member 63 is compressed; and a moving force is also applied to the toner cartridge 15 with the rotation of the developing unit 24, but movement of the toner cartridge 15 can be regulated by the contact wall 200.

According to the second embodiment, as illustrated in FIG. 11B, when the toner cartridge 15 is simply mounted to the frame 40, the seal member 63 is compressed.

Therefore, it is possible to more reliably suppress occurrence in a gap between the seal member 63 and the toner supply port 97 and occurrence in a gap between the seal member 63 and the toner receiving port 73.

According to the second embodiment, as illustrated in FIG. 11B, since the seal member 63 presses the conveyance tube 94 of the toner cartridge 15 in the direction orthogonal to the mounting-and-demounting direction of the toner cartridge 15 in the state where the toner cartridge 15 is mounted to the frame 40, it is possible to suppress the demounting of the toner cartridge 15 from the frame 40.

The second embodiment may also have the same operational advantages as in the first embodiment described above.

11. Third Embodiment

Figure 12:
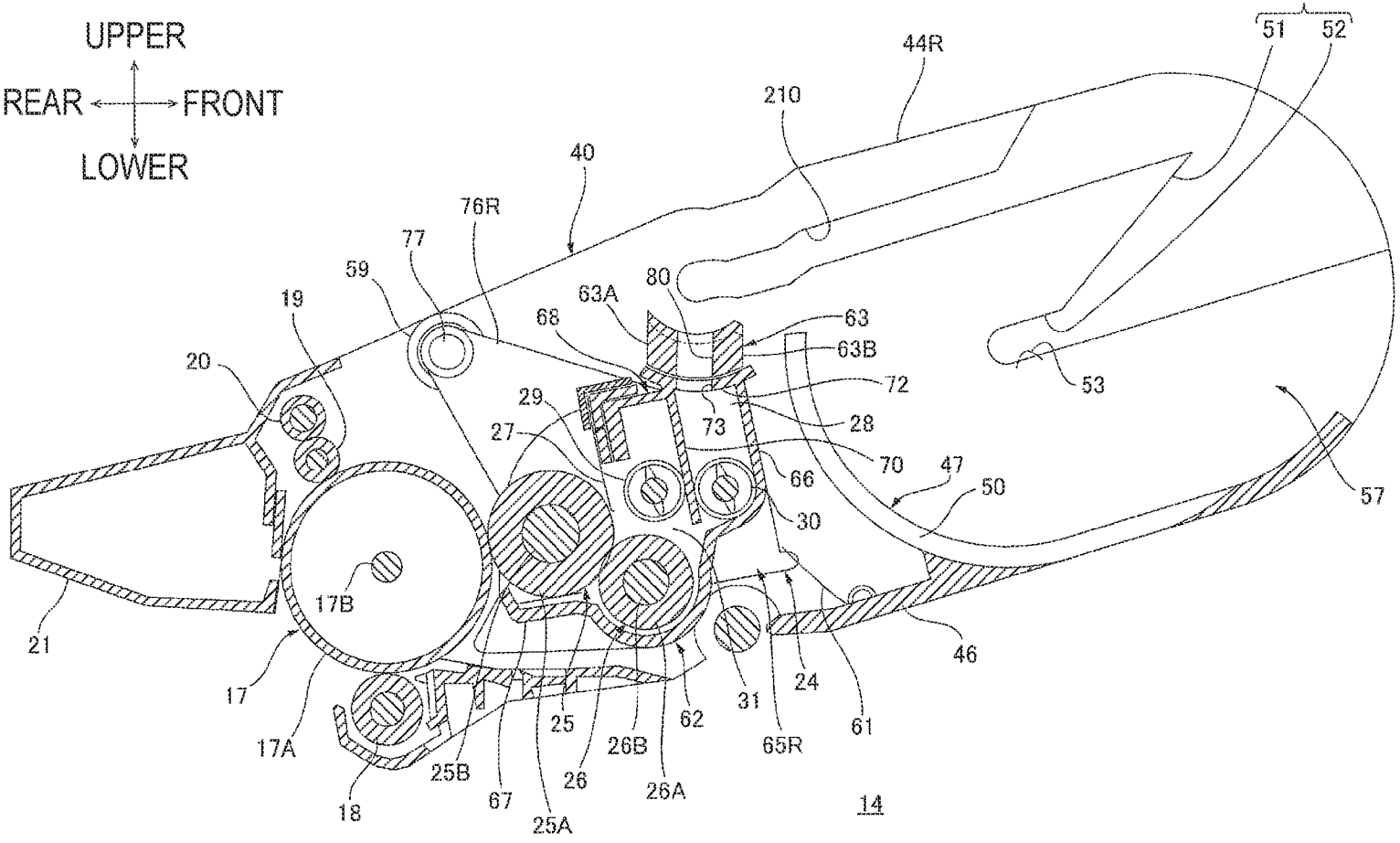
FIG. 12 is a cross-sectional view at a center of a drum cartridge in an image forming apparatus according to a third embodiment of the invention.
Figure 13:
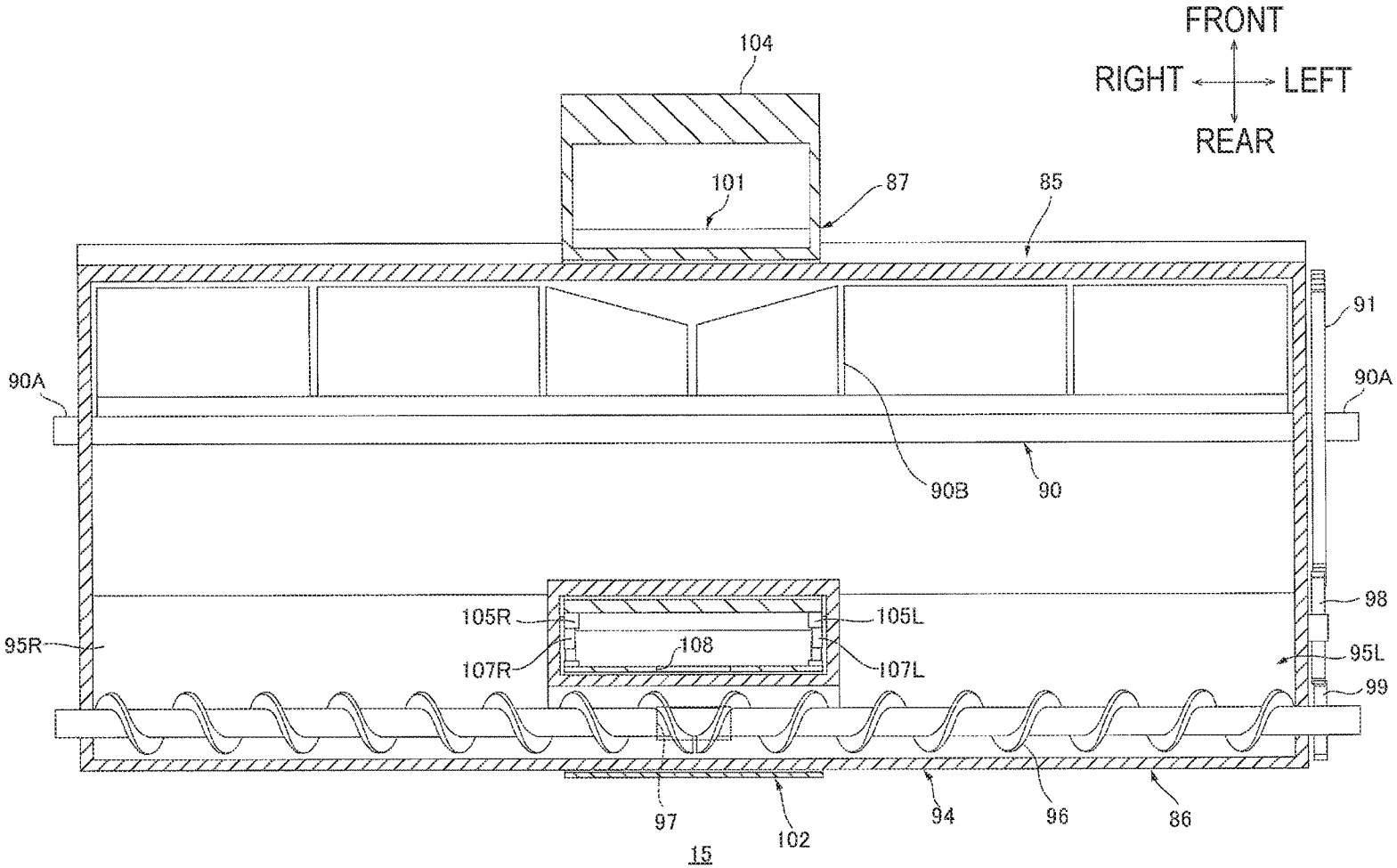
FIG. 13 illustrates a toner cartridge in the image forming apparatus according to the third embodiment of the invention and is a cross-sectional view of the toner cartridge corresponding to the toner cartridge illustrated in FIG. 6.

With reference to FIGS. 12 and 13, an image forming apparatus according to a third embodiment of the invention will be described. In the third embodiment, the same members as in the first and second embodiments will be designated by the same reference numerals, and the description thereof will be not presented.

In the first embodiment, as illustrated in FIGS. 2A and 7A, the frame 40 includes the partition wall 48 that receives the conveyance tube 94 of the conveyance portion 86 of the toner cartridge 15.

In the second embodiment, as illustrated in FIGS. 11A and 11B, the frame 40 includes the contact wall 200, and the conveyance tube 94 of the conveyance portion 86 is received by the contact wall 200 and the seal member 63.

In contrast, as illustrated in FIG. 12, a sidewall 44R of the frame 40 includes a guide groove 210 in the third embodiment. In addition, the sidewall 44L of the frame 40 includes a guide groove 210, similarly to the sidewall 44R.

The guide groove 210 is positioned at an upper end of the sidewall 44R. The guide groove 210 is recessed outward in the right-left direction from an inner surface in the right-left direction of the sidewall 44R. The guide groove 210 continuous to an upper end of a first groove 51. The guide groove 210 extends rearward from the upper end of the first groove 51. A rear end of the guide groove 210 is positioned above a seal member 63.

In third embodiment, as illustrated in FIG. 13, a right end of an auger screw 96 protrudes rightward beyond a right wall of a coupling tube 95R in a toner cartridge 15. A left end of a conveyance portion 86 protrudes leftward beyond a left wall of a coupling tube 95L.

Then, the toner cartridge 15 is mounted to the toner cartridge mounting portion 57 such that the right end of the auger screw 96 matches with the guide groove 210 of the sidewall 44R and the left end of the auger screw 96 matches with the guide groove 210 of the sidewall 44L.

Thus, the right end of the auger screw 96 is fitted into a rear end of the guide groove 210 of the sidewall 44R. The left end of the auger screw 96 is fitted into a rear end of the guide groove 210 of the sidewall 44L.

Then, when a developing unit 24 rotates in a counterclockwise direction as seen in left side view, both right and left ends of the auger screw 96 abut on an upper surface of a front end of the guide groove 210.

In this way, movement of the toner cartridge 15 is regulated by the guide groove 210. That is, an upper wall of the rear end of the guide groove 210 is configured as an example of a contact wall.

The third embodiment may also have the same operational advantages as in the first embodiment described above.

12. Modification Example of First Embodiment

Figure 14A:
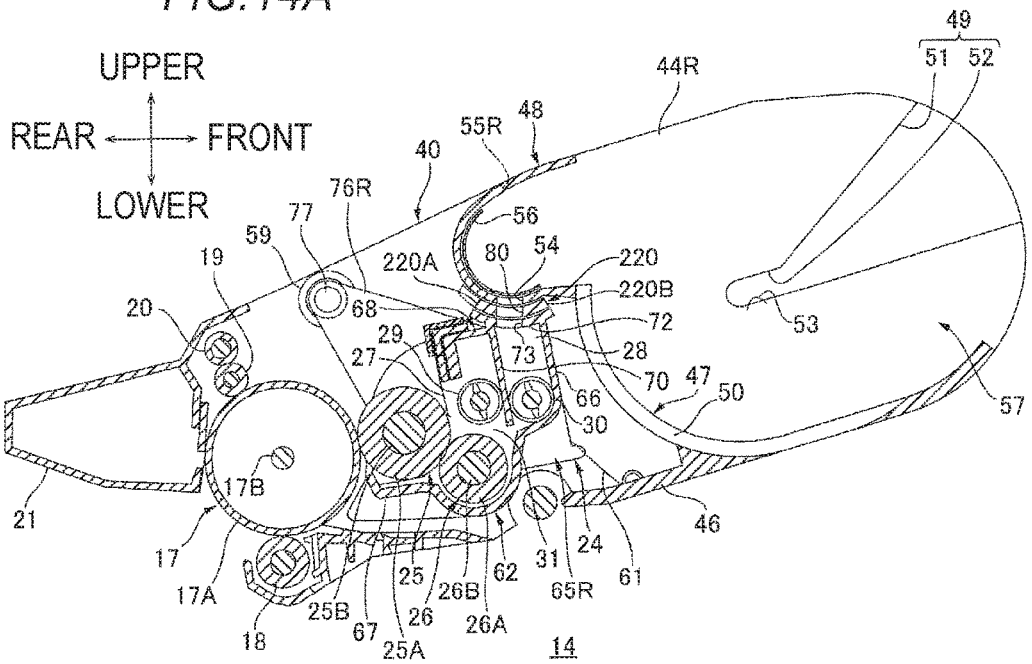
FIG. 14A is a cross-sectional view at a center of a drum cartridge according to a modification example of the first embodiment.
Figure 14B:
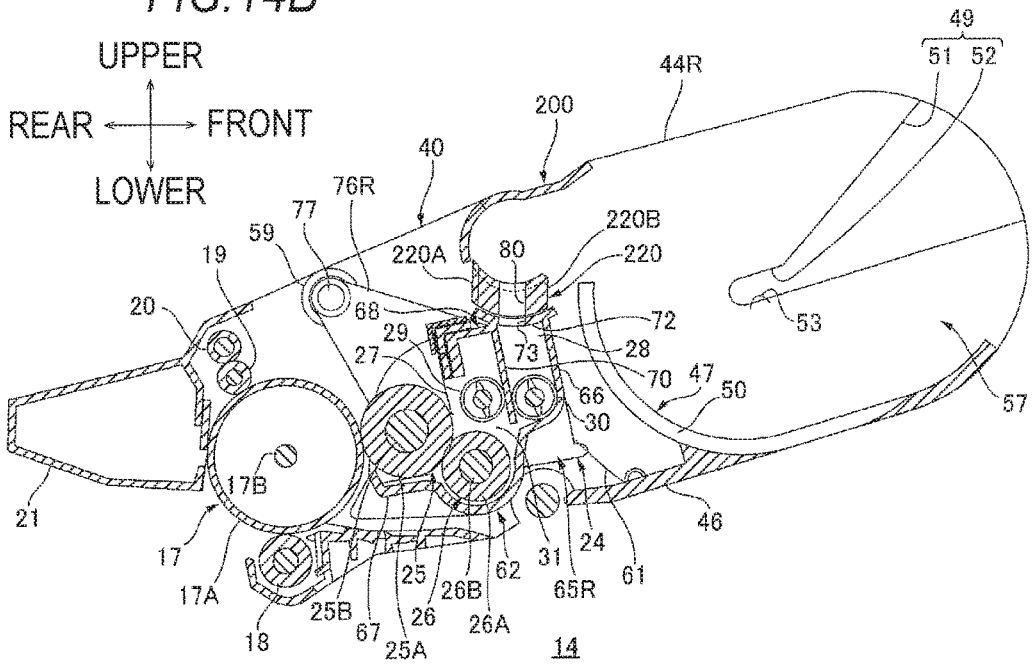
FIG. 14B is a cross-sectional view at a center of a drum cartridge according to a modification example of the second embodiment.

An image forming apparatus according to a modification example of the first embodiment of the invention will be described below with reference to FIG. 14A.

In the first embodiment described above, the developing unit 24 includes the seal member 63, but may includes a seal member 220 instead of the seal member 63, the seal member having a dimension longer than the seal member 63 in the front-rear direction.

The seal member 220 is positioned on an upper surface of a curved portion 72. A rear end of the seal member 220 protrudes rearward from a rear end of the curved portion 72.

In such a case, when a developing unit 24 rotates in a counterclockwise direction as seen in left side view, that is, rotates to approach a toner cartridge 15, the rear end of the seal member 220 is not compressed, and only a part coming in contact with the curved portion 72 is compressed.

Specifically, a part of the curved portion 72 in the rear of the toner receiving port 73 approaches the rear outer circumferential surface of the partition wall 48 in the rear of the toner communication opening 54, and thus a rear end 220A (first end) coming in contact with the rear end of the curved portion 72 in the seal member 220 is compressed. In addition, a part of the curved portion 72 in front of the toner receiving port 73 approaches the front outer circumferential surface of the partition wall 48 in front of the toner communication opening 54, and thus the a rear end 220B (second end) coming in contact with the front end of the curved portion 72 in the seal member 220 is compressed.

The modification example of the first embodiment may also have the same operational advantages as in the first embodiment described above.

13. Modification Example of Second Embodiment

An image forming apparatus according to a modification example of the second embodiment of the invention will be described below with reference to FIG. 14A.

In the second embodiment, the developing unit 24 includes the seal member 63, but may include the seal member 220 according to the modification example of the first embodiment described above, instead of the seal member 63.

In this case, the seal member 220 is compressed by a conveyance tube 94 and a curved portion 72.

The modification example of the second embodiment may also have the same operational advantages as in the second embodiment described above.

14. Modification Example

The invention is not limited to the embodiments described above. For example, the rotating shaft 77 may be supported by the sidewall 44R and the sidewall 44L through a bearing.

In addition, the rotating shaft 77 may be formed integrally with the arm 76R and the arm 76L.

The arm 76R and the arm 76L include the rotating shaft 77 in the embodiments described above, but the sidewall 44R and the sidewall 44L may be configured to include the rotating shaft 77. In this case, the arm 76R and the arm 76L include the support portion 59, and the rotating shaft 77 of the sidewall 44R and the sidewall 44L is inserted into the support portion 59.

In addition, the rotating shaft 77 may be formed integrally with the sidewall 44R and the sidewall 44L.

The drum shaft 17B is supported by the sidewall 44L and the sidewall 44R in the embodiments described above, but may be supported by the sidewall 44L and the sidewall 44R through the bearing.

In addition, the number of springs 61 is two, but may be one or at least three without being limited thereto.

Furthermore, the number of separation members 172 is two, but may be one without being limited thereto.

The hole 60 has substantially the arc shape, in which the support portion 59 is centered, in the embodiments described above, but may have substantially a circular shape having a diameter larger than that of the protrusion portion 26CR and the protrusion portion 26CL.

What is claimed is:

1. An image forming apparatus comprising:

a frame;

a photosensitive drum that is supported by the frame;

a developing unit that is rotatable around a rotating shaft supported by the frame and includes a developing frame having a toner receiving port and a developing roller;

a toner cartridge that has a toner supply port; and a seal member positioned in a circumference of the toner receiving port and being deformable, wherein the seal member has a communication opening, which communicates between the toner receiving port and the toner supply port in a state where the toner cartridge is mounted to the frame, and the seal member has a first end and a second end positioned at a side opposite to the first end with the communication opening interposed therebetween, wherein the first end of the seal member and the second end of the seal member are configured to be compressed when the developing unit rotates to approach the toner cartridge, and wherein the seal member is deformable along a direction orthogonal to a mounting-and-demounting direction of the toner cartridge with respect to the frame.

2. The image forming apparatus according to claim 1, wherein the rotating shaft is positioned on a virtual line that passes a contact portion between the photosensitive drum and developing roller, and the virtual line is orthogonal to a line passing between an axial line of the photosensitive drum and an axial line of the developing roller.

3. The image forming apparatus according to claim 1, wherein the developing unit includes a protrusion portion that protrudes in an axial direction of the photosensitive drum, and wherein the frame includes a hole that receives the protrusion portion.

4. The image forming apparatus according to claim 1, further comprising:

a spring that is configured to press the developing roller toward the photosensitive drum.

5. The image forming apparatus according to claim 1, wherein the seal member is deformable along a rotation direction of the developing unit.

6. The image forming apparatus according to claim 1, wherein the frame includes a partition wall that is positioned between the toner cartridge and the seal member in a state where the toner cartridge is mounted to the frame, and wherein the partition wall has a toner communication opening to communicate between the toner receiving port and the toner supply port.

7. The image forming apparatus according to claim 1, wherein the frame includes a contact wall which comes in contact with the toner cartridge in a state where the toner cartridge is mounted to the frame, and wherein the contact wall is positioned at a side opposite to the seal member with respect to the toner cartridge in a rotation direction of the developing unit.

8. The image forming apparatus according to claim 1, wherein the toner cartridge is configured to compress the seal member in a state where the toner cartridge is mounted to the frame.

9. The image forming apparatus according to claim 1, wherein the rotating shaft is positioned above the photosensitive drum and the developing roller.

10. The image forming apparatus according to claim 1, wherein the toner cartridge includes:

a toner accommodating portion that accommodates toner; and a conveyance portion that is configured to convey the toner contained in the toner accommodating portion to the developing unit, wherein the conveyance portion is positioned above the seal member and has the toner supply port, and wherein at least a part of the toner accommodating portion is positioned below the seal member.

11. The image forming apparatus according to claim 3, further comprising:

a separation member that is configured to separate the developing roller being in contact with the photosensitive drum from the photosensitive drum, wherein the separation member presses the protrusion portion to separate the developing roller from the photosensitive drum.

12. An image forming apparatus comprising:

a frame;

a photosensitive drum that is supported by the frame;

a developing unit that is rotatable around a rotating shaft supported by the frame and includes a developing frame having a toner receiving port and a developing roller;

a toner cartridge that has a toner supply port; and a seal member positioned in a circumference of the toner receiving port and being deformable, wherein the seal member has a communication opening, which communicates between the toner receiving port and the toner supply port in a state where the toner cartridge is mounted to the frame, and the seal member has a first end and a second end positioned at a side opposite to the first end with the communication opening interposed therebetween, wherein the first end of the seal member and the second end of the seal member are configured to be compressed when the developing unit rotates to approach the toner cartridge, wherein the frame includes a partition wall that is positioned between the toner cartridge and the seal member in a state where the toner cartridge is mounted to the frame, and wherein the partition wall has a toner communication opening to communicate between the toner receiving port and the toner supply port.

13. An image forming apparatus comprising:

a frame;

a photosensitive drum that is supported by the frame;

a developing unit that is rotatable around a rotating shaft supported by the frame and includes a developing frame having a toner receiving port and a developing roller;

a toner cartridge including:

a toner accommodating portion that accommodates toner; and a conveyance portion that is configured to convey the toner contained in the toner accommodating portion to the developing unit and including a toner supply port; and a seal member positioned in a circumference of the toner receiving port and being deformable, wherein the seal member has a communication opening, which communicates between the toner receiving port and the toner supply port in a state where the toner cartridge is mounted to the frame, and the seal member has a first end and a second end positioned at a side opposite to the first end with the communication opening interposed therebetween, wherein the conveyance portion is positioned above the seal member, wherein at least a part of the toner accommodating portion is positioned below the seal member, and wherein the first end of the seal member and the second end of the seal member are configured to be compressed when the developing unit rotates to approach the toner cartridge.

* * * * *